US010475287B1

(12) United States Patent
Däumling et al.

(10) Patent No.: US 10,475,287 B1
(45) Date of Patent: Nov. 12, 2019

(54) GAMING SYSTEM AND METHOD OF STORING SYMBOLS TO OBTAIN ENHANCED AWARDS

(71) Applicant: ADP GAUSELMANN GMBH, Espelkamp (DE)

(72) Inventors: Uwe Däumling, Ibbenbüren (DE); Uwe Horn, Kiel (DE)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/151,142

(22) Filed: Oct. 3, 2018

(51) Int. Cl.
*G07F 17/32* (2006.01)
*G06Q 50/34* (2012.01)
*G07F 17/34* (2006.01)

(52) U.S. Cl.
CPC ..... *G07F 17/3267* (2013.01); *G06Q 50/34* (2013.01); *G07F 17/3211* (2013.01); *G07F 17/3258* (2013.01); *G07F 17/34* (2013.01)

(58) Field of Classification Search
None
See application file for complete search history.

(56) References Cited

U.S. PATENT DOCUMENTS 5,833,537 A 11/1998 Barrie
6,186,894 B1 * 2/2001 Mayeroff ..... G07F 17/32 273/138.1
7,794,320 B2 9/2010 Baerlocher et al.
7,846,018 B2 12/2010 Baerlocher
8,337,300 B2 12/2012 Bowers et al.
8,491,375 B2 7/2013 Low
8,585,485 B2 11/2013 Guinn
9,230,409 B2 1/2016 Pawloski
9,928,691 B2 3/2018 Olive
10,037,651 B2 7/2018 You et al.
(Continued)

FOREIGN PATENT DOCUMENTS

AU 2014903132 8/2014
AU 2015210489 A1 2/2016
(Continued)

OTHER PUBLICATIONS

Aristocrat Technologies Australia Pty Ltd., "Lightning Link", Retrieved from the Internet on Oct. 25, 2018: http://www.aristocrat-us.com/lightning-link, p. 1.

*Primary Examiner* — James S. McClellan
*Assistant Examiner* — Peter J Iannuzzi
(74) *Attorney, Agent, or Firm* — Resolute Legal PLLC

(57) ABSTRACT

Various implementations of a gaming system and method perform operations including generating and displaying symbols, where a player collects and stores predetermined symbols. The operations also include converting the predetermined symbols into awards for the player. The operations further include generating and displaying a new plurality of symbols and enabling the player to collect and store predetermined symbols from the generated new plurality of symbols while the gaming system also displays nudge symbols. The operations further include moving symbols in a column of displayed symbols when one of a plurality of columns of displayed symbols includes a nudge symbol. The nudge symbols in a column of displayed symbols may prevent replacement of the displayed symbols in the column with the newly generated symbols.

19 Claims, 19 Drawing Sheets

(56) References Cited

U.S. PATENT DOCUMENTS

| | | | | |
|---|---|---|---|---|
| 2002/0043759 | A1 | 4/2002 | Vancura | |
| 2002/0045474 | A1 | 4/2002 | Singer et al. | |
| 2004/0009808 | A1 | 1/2004 | Gauselmann | |
| 2004/0048646 | A1 | 3/2004 | Visocnik | |
| 2004/0053673 | A1 | 3/2004 | Mishra | |
| 2004/0204228 | A1 | 10/2004 | Walker et al. | |
| 2008/0045302 | A1 | 2/2008 | Low | |
| 2008/0248865 | A1 | 10/2008 | Tedesco et al. | |
| 2009/0221353 | A1 | 9/2009 | Joung | |
| 2010/0029381 | A1* | 2/2010 | Vancura | G07F 17/3244 463/30 |
| 2010/0120489 | A1 | 5/2010 | Meyer | |
| 2010/0190542 | A1 | 7/2010 | Mizue | |
| 2010/0197377 | A1 | 8/2010 | Aoki et al. | |
| 2010/0304833 | A1 | 12/2010 | Berman | |
| 2011/0003627 | A1 | 1/2011 | Nicely et al. | |
| 2011/0111829 | A1 | 5/2011 | Joung | |
| 2011/0117989 | A1 | 5/2011 | Kennedy et al. | |
| 2011/0136565 | A1 | 6/2011 | Low | |
| 2012/0231868 | A1 | 9/2012 | Guinn | |
| 2012/0295688 | A1* | 11/2012 | Watkins | G07F 17/3211 463/20 |
| 2014/0018146 | A1 | 1/2014 | Zielinski et al. | |
| 2014/0087821 | A1 | 3/2014 | Zoltewicz et al. | |
| 2014/0087860 | A1 | 3/2014 | Basallo et al. | |
| 2014/0087861 | A1 | 3/2014 | Basallo et al. | |
| 2014/0309010 | A1 | 10/2014 | Pawloski | |
| 2015/0080096 | A1 | 3/2015 | Saunders et al. | |
| 2015/0141114 | A1 | 5/2015 | Davis et al. | |
| 2015/0248810 | A1 | 9/2015 | Wortmann et al. | |
| 2016/0042597 | A1 | 2/2016 | Olive | |
| 2016/0253873 | A1 | 9/2016 | Olive | |
| 2016/0335842 | A1 | 11/2016 | Zoble et al. | |
| 2017/0032610 | A1 | 2/2017 | Loz et al. | |
| 2017/0092067 | A1 | 3/2017 | Batsiokis | |
| 2017/0124809 | A1 | 5/2017 | Elias | |
| 2017/0154498 | A1 | 6/2017 | Olive | |
| 2018/0082535 | A1* | 3/2018 | Filipour | G07F 17/3267 |
| 2018/0082546 | A1 | 3/2018 | Mariscal et al. | |
| 2018/0122183 | A1 | 5/2018 | Wortmann | |
| 2018/0130298 | A1 | 5/2018 | Koshorek | |
| 2018/0218572 | A1 | 8/2018 | Caputo | |
| 2018/0225914 | A1 | 8/2018 | Heenan et al. | |
| 2018/0261045 | A1 | 9/2018 | Takahara et al. | |
| 2018/0268655 | A1 | 9/2018 | Olive | |
| 2018/0268657 | A1 | 9/2018 | Kroon | |
| 2018/0286183 | A1 | 10/2018 | Davis et al. | |

FOREIGN PATENT DOCUMENTS

| | | | |
|---|---|---|---|
| AU | 2016900462 | | 2/2016 |
| AU | 2016100230 | A4 | 3/2016 |
| AU | 2016202727 | A1 | 5/2016 |
| AU | 2016101967 | A4 | 12/2016 |
| AU | 2017200840 | A1 | 3/2017 |
| AU | 2017204560 | A1 | 7/2017 |
| AU | 2017101097 | A4 | 9/2017 |
| AU | 2017101098 | A4 | 9/2017 |
| AU | 2017101629 | A4 | 12/2017 |
| AU | 2017101730 | A4 | 1/2018 |
| AU | 2017101731 | A4 | 1/2018 |
| AU | 2018278882 | A1 | 1/2019 |
| AU | 2019200719 | A1 | 2/2019 |

* cited by examiner

Storage Symbol Award Values Pay Table

50
100
250
350
1000
5000
Mini Bonus
Medi (Bonus)
Max (Internal Jackpot)
Mega (Linked Jackpot)

Nudge Symbol Pay Table

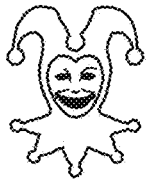

2x anywhere = 100
3x anywhere = 350
4x anywhere = 500
5x anywhere = 5000

Bonus/Jackpot Pay Table

MINI BONUS (Internal Bonus): The level value depends on the bet/wager:
Bet 40: Level value 1,000.
Bet 80: Level value 2,000.
Bet 120: Level value 3,000.
Bet 160: Level value 4,000.
Bet 200: Level value 5,000.

MEDI BONUS (Internal Bonus): The level value depends on the bet/wager:
Bet 40: Level value 5,000.
Bet 80: Level value 10,000.
Bet 120: Level value 15,000.
Bet 160: Level value 20,000.
Bet 200: Level value 25,000.

MAX (Internal Jackpot): The Jackpot value is variable:
Range: 15,000 to 100,000.

MEGA (Link Jackpot): The Jackpot value is variable:
Range: 1,000,000 to 2,000,000.

Note: Data are only examples

*Fig. 5*

GAMING SYSTEM AND METHOD OF STORING SYMBOLS TO OBTAIN ENHANCED AWARDS

FIELD OF THE INVENTION

The present disclosure relates to gaming devices.

BACKGROUND

Gaming machines that accept wagers in exchange for the opportunity to win awards or prizes are known. Gaming machines that offer new ways to win awards or prizes are needed to gain and retain players' interest in the gaming machines.

SUMMARY

Various implementations of a gaming system and method include generating and displaying a plurality of symbols, where a player collects and stores predetermined symbols that are included in the plurality of generated symbols. The gaming system may convert the stored predetermined symbols into one or more awards for the player. In some implementations, the gaming system continues to generate and display a new plurality of symbols and enables the player to collect and store predetermined symbols from the generated new plurality of symbols while the gaming system also displays nudge symbols. In some implementations, the gaming system moves symbols in a column of displayed symbols when one of a plurality of column of symbols includes a nudge symbol. In some implementations, the nudge symbols in a column of displayed symbols may prevent the gaming system from replacing the displayed symbols in the column with the generated new plurality of symbols.

In some implementations, the gaming system includes symbol display areas associated with video-based slot machine reels. For example, the gaming system may include five video-based slot machine reels that are each associated with three symbol display areas. It should be appreciated that in various embodiments, the quantity of reels can be increased or decreased. For example, in some implementations, the quantity of reels can be 3, 4, 6, or some other suitable quantity of reels. It should also be appreciated that in some implementations the quantity of symbol display areas of the reels can vary. In some implementations, the quantity of symbol display areas can be 2, 3, 4, 5, 6, or some other suitable quantity of symbol display areas. The gaming system may further include a symbol set that provides symbols associated with each slot machine reel. Further, the gaming machine may include pay lines corresponding to various combinations of symbol display areas. For example, the pay lines may cross the symbol display areas horizontally, vertically, and diagonally. A player may selectively activate one or more of the pay lines by placing wagers on such pay lines. For example, selecting a minimum wager amount may activate only one pay line, selecting additional wager amounts may activate additional pay lines, and selecting a maximum wager amount may activate all pay lines. For a play of a game, the gaming system may generate symbols from the associated symbol sets for the symbol display areas of the reel. The gaming system may evaluate the generated symbols to identify winning symbol combinations and determine a payout amount based on the winning symbol combinations along wagered pay lines. In some implementations, the gaming system may use other methods to determine winning symbol combinations in addition to or without pay lines. For example, the gaming system may evaluate the displayed symbols for scatter pay symbols, ways pays, etc. In some implementations with ways pays, the gaming system can determine a payout amount based on the gaming system generating one or more predetermined symbols on consecutive reels where the predetermined symbols are adjacent. The gaming system may also evaluate the generated symbols for symbol combinations that trigger a bonus game. In some implementations, at least one symbol from the symbol sets are designated as a triggering symbol. In some implementations, the triggering symbol is also designated as a nudge symbol. If the gaming system determines that a predetermined quantity of triggering symbols are generated, the gaming system may activate a bonus game.

In accordance with some aspects of the present disclosure, the gaming system alters the play of the game during the bonus game. In some implementations, the gaming system may add one or more storage symbols to one or more of the existing symbol sets associated with the slot machine reels that the gaming system may generate and display during the bonus game. In some implementations, the gaming system may not generate new symbols for any slot machine reel that includes a visible nudge symbol. In some implementations, the gaming system causes any slot machine reel with a visible nudge symbol to shift one or more symbol positions (e.g., increment one indexed position of a reel). In some implementations, symbols other than the nudge symbols or storage symbols are not associated with functions in the bonus game. In some implementations, the gaming system does not evaluate displayed symbols on the slot machine reels unless the symbols are either the nudge symbols or the storage symbols.

Additionally, in accordance with aspects of the present disclosure, when the gaming system activates the bonus game, the gaming system may keep the last generated and displayed symbols in the symbol display areas. In some implementations, for the duration of the bonus game, the gaming system may modify the symbol display areas so as to shade or deemphasize symbols that are not the nudge symbols or the storage symbols. In some implementations, the symbols that are not nudge symbols or the storage symbols may not result in any awards during the bonus game. In some implementations, the gaming system causes one or more of the slot machine reels with a nudge symbol to rotate or shift one symbol position. In some implementations, a slot machine reel that has shifted or rotated may reveal one new symbol in a symbol display area of the slot machine reel and remove one previously visible symbol in another symbol display area of the slot machine reel. In some implementations, the gaming system evaluates the visibly displayed symbols to determine if a predetermined quantity of nudge symbols is displayed in the symbol display areas in accordance with a nudge symbol pay table. If the gaming system determines that a predetermined quantity of nudge symbols is visible in accordance with the nudge symbol pay table, the gaming system may issue one or more awards based on the nudge symbol pay table. In some implementations, the gaming system also generates symbols from an associated symbol set for one or more reels that do not display a visible nudge symbol.

Further, in accordance with aspects of the present disclosure, the gaming system may evaluate the visible symbols for storage symbols. In some implementations, if at least one storage symbol is visible, the gaming system may move the storage symbols to a symbol storage area that is separate and apart from symbol display areas of the slot machine reels. In some implementations, the gaming system removes the moved storage symbols from slot machine reel, which results in a symbol display area without a displayed symbol. In some implementations, the gaming system may move the storage symbols to a symbol storage area on a separate display screen of the gaming system. In some implementations, the symbol storage area includes symbol display areas respectively corresponding to the symbol display areas of the slot machine reels. In such implementations, the gaming system may move the storage symbols to a symbol display area of the symbol storage area corresponding with the respective symbol display area of the slot machine reel.

Moreover, in accordance with aspects of the present disclosure, when the gaming system determines that at least one of the slot machine reels includes a visible nudge symbol, the gaming system may repeat the previously described features of the bonus game until the gaming system determines that no visible nudge symbols are on the slot machine reels.

Also, in accordance with aspects of the present disclosure, when the gaming system determines that no nudge symbols were visible, the gaming system may convert the storage symbols in the symbol storage area into awards. In some implementations, the gaming system may randomly determine the awards associated with the storage symbols in the symbol storage area. In some implementations, the gaming system may determine the awards associated with storage symbols before or during a play of the game. In some implementations, the awards include a different predetermined credit values. In some implementations, the awards may include a mini jackpot award, a medium jackpot award, or a maximum jackpot award. In some implementations, the mini, medium, and maximum jackpot awards vary based on a player's wager for a play of the game (e.g., selecting a minimum wager may provide a minimum jackpot and selecting a maximum wager may provide a maximum jackpot). In some implementations, the gaming system is linked to other gaming systems and the gaming system can provide a mega jackpot award depending on how the jackpot award is funded.

It should be appreciated that in some implementations, the nudge symbol may serve additional or different functions. For example, in some implementations, the nudge symbol can be a trigger symbol. In some implementations during one play of a game, the gaming system stops evaluating the nudge symbol as a trigger symbol once the nudge symbol triggers a game function during the one play of the game. In some implementations, the nudge symbol can provide awards based on a nudge pay table. In some implementations including a base game and a bonus game, the nudge symbol may initially function as a trigger symbol during the base game and function as a pay symbol during the bonus game. For example, in some implementations, the nudge symbol can be a trigger symbol during a base game and ceases to be a trigger symbol in an associated bonus game. In some implementations, the nudge symbol is not a pay symbol during a base game, but becomes a pay symbol during a bonus game. In some implementations, the nudge symbol can cause a gaming system to nudge slot machine reels and also controls whether a gaming system generates new symbols from the symbol sets. In one such implementation, the nudge symbol prevents a gaming system from generating new symbols for slot machine reels with the nudge symbol.

As described above and set forth in greater detail below, gaming machines in accordance with aspects of the present disclosure provide a specialized computing device including non-conventional hardware and software that improve upon the existing technology of human-computer interfaces by providing functionality of generating display outputs that enable players to obtain and store storage symbols and convert these storage symbols into new awards. Doing so improves the operation of the gaming machines for their specialized purpose by reducing player disappointment with game outcomes and enhancing player excitement for a play of a game.

BRIEF DESCRIPTION OF THE DRAWINGS

FIG. 5 illustrates example data structures showing pay tables that the gaming system may use in accordance with aspects of the present disclosure.

DETAILED DESCRIPTION

Figure 1:
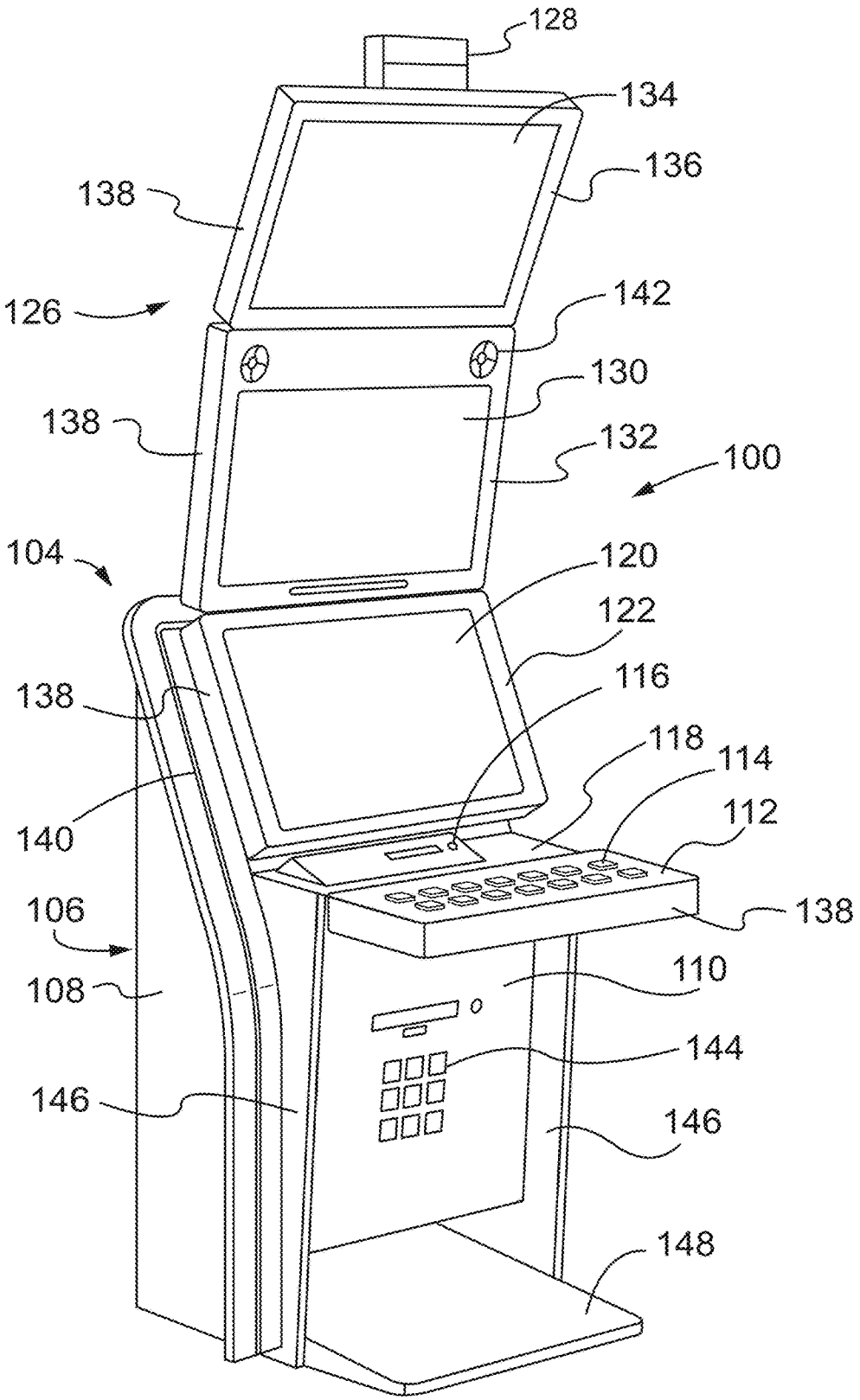
FIG. 1 shows a perspective view illustrating an example gaming device in accordance with aspects of the present disclosure.

Various implementations of a gaming system and method include generating and displaying a symbols, where a player collects and stores predetermined symbols that are included in the generated symbols. The gaming system may convert the stored predetermined symbols into one or more awards for the player. In some implementations, the gaming system continues to generate and display new symbols and enables the player to collect and store predetermined symbols from the generated new symbols while the gaming system also displays nudge symbols. In some implementations, the gaming system moves symbols in a column of displayed symbols when one of a plurality of columns of displayed symbols includes a nudge symbol. In some implementations, a nudge symbol in a column of displayed symbols may prevent the gaming system from replacing the displayed symbols in the column with the generated new symbols.

In some implementations, a gaming system includes a cabinet, a processor, a display device supported by the cabinet, an input device supported by the cabinet, a value acceptor supported by the cabinet, a value dispenser supported by the cabinet, and a memory device that stores a program instructions. The program instructions, when executed by the processor, control the gaming device to perform operations including establishing a credit balance based at least in part on a monetary value received by the value acceptor. The operations can also include placing a wager following receipt of a wager input via an input device, the credit balance being decreased by the wager. The operations can also include randomly generating first symbols from symbol sets, displaying, on the display device, the first symbols in symbol display areas, the first symbols being respectively associated with a separate one of the symbol display areas and the symbol display areas being arranged in columns. The operations can also include determining whether a nudge symbol is in the first symbols. The operations can also include randomly generating and displaying second symbols for at least one of the columns that does not display a nudge symbol. The second symbols can replace the first symbols in the at least one of the columns, the displayed second symbols and the remaining displayed first symbols forming the currently displayed symbols. The operations can also include displaying, on the display device, the determined nudge awards based on nudge symbols in the currently displayed symbols and determining whether a storage symbol is in the currently displayed symbols, storing any determined storage symbols in a symbol storage area separate from the symbol display areas; and converting the storage symbols to storage symbol award values. The operations can also include displaying, on the display device, the storage symbol award values, the credit balance being increased by the storage symbol award values; and issuing value from the value dispenser based on the credit balance upon receipt of a cash out signal via the input device.

Gaming Device Platform

The features and advantages of the gaming system and method described herein may be provided to a player via a gaming device platform that includes various structures and components for allowing player interaction with the gaming device. While only one gaming device platform will be described in detail herein, it is understood that the features, objects, and advantages of the gaming system described herein may be implemented in one or more alternative gaming device platforms.

FIG. 1 shows a perspective view illustrating an example of gaming device 100 in accordance with aspects of the present disclosure. Such gaming device 100 may be referred to as a slot machine and, as illustrated, is housed in a cabinet 104 (e.g., a housing) constructed so that a player can operate and play the gaming device 100 while standing or sitting. The cabinet 104 can include a lower cabinet body portion 106, which includes a pair of cabinet side panels 108 (only one of which is viewable in the perspective view of FIG. 1), a front panel 110, and a rear panel (not shown). Additionally, a base panel (not shown) and a top panel surface (not shown) may support a first game display 120 and the player interaction area 112. The cabinet panels 104, 106, 108, 110 (as well as the base panel and the top panel surface) may be interconnected along their edges and cooperate to form the cabinet 104, which encloses and houses components of the gaming device 100, as can be seen in FIG. 1. The cabinet 104 may function to securely protect local control system, technology components, and provide support for game display(s) and player input and output interactions with the gaming device 100, such as describe herein below.

While the example cabinet 104 is depicted as having a particular shape, structure, and organization, it should be appreciated that a wide variety of cabinet enclosure sizes, shapes, and designs are possible for the gaming device 100. For example, the cabinet panels 104, 106, 108, 110 (as well as the base panel and the top panel surface) may be combined into fewer elements or divided into additional elements. Additionally, the positions of the displays (e.g., first display 120) and input/output devices can be reorganized and/or relocated with respect to one another.

In accordance with aspects of the present disclosure, a player can interact with the gaming device 100 in various ways to direct the wagering and game play activities and preferences. More specifically, the cabinet 104 includes having input and output areas generally designated as the player interaction area 112. The player interaction area 112 may be located on the front top side of cabinet 104 and, as shown, on a panel structure that extends outwardly from the gaming device 100 in a player's direction. The player interaction area 112 may contain player input and output structures, including a player control button area 114, a player value acceptor and dispenser area 116, and player convenience input area 118.

The player control button area 114 includes buttons, touch sensitive areas, or both through with which players may interact with the one or more processors of the gaming device 100 so as to direct game play. It is expected that the cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in some implementations, a player's gaming control interactions could be made by either the buttons or functionally equivalent "soft" buttons located on the gaming display and activated by player touch (e.g., touch screen interfaces), or a combination of both arrangements.

The buttons may include the following: game selection button(s) in any implementation where more than one game is provided in a single gaming device 100; gaming denomination value selection button(s) in any implementations where one or more wagering denomination value is accommodated; wager selection button(s) for the player to indicate or select the desired wager value for a game in any implementations where a selection of wager values are offered; pay line selection button(s) for selecting the number of active pay lines in game implementations that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information.

The player value acceptor and dispenser area 116 may include one or more forms of value acceptance and value distribution to allow the player to interact with the device and to risk or otherwise place a wager (a monetary value) on one or more outcomes of a game. Winnings may be returned to the player via some form of value distribution. In the player value acceptor and dispenser area 116, a player can supply monetary value to the gaming device 100 via one or more value acceptor devices. In some implementations, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device 100 includes a ticket acceptor as a value acceptor device for receiving tickets or vouchers representing some monetary value. The ticket acceptor may include a bar code reader, or other appropriate code reader, for reading the encoded value contained by the player's ticket or voucher. In some implementations, the player value acceptor and dispenser area 116 may include a value acceptor device that can accept more than one type of value. In some implementations, the player value acceptor and dispenser area 116 may include multiple different value acceptor devices to accept different types of value from players Upon receipt of some type of value from the player, the value acceptor device of the player value acceptor and dispenser area 116 can perform validation on the player supplied value using appropriate hardware readers (e.g., determining that the currency bills/coins/tokens are genuine or the ticket/voucher is genuine). If the validation result is positive on player supplied value, the appropriate value acceptor device can generate a signal to a processor of the gaming device 100 to establish a gaming credit balance for plays of one or more games on gaming device 100.

In some implementations, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. The gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other implementations, hardware for transferring (and receiving) non-traditional currencies to players such as digital currencies (e.g., bitcoin) may be included in gaming device 100.

In some implementations, the gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device 100 may be associated with the player account. It is noted that a numeric or alphanumeric keypad may be provided adjacent to the card reader slot to enable player entry of a personal identification number or the like for secure access to card information.

In some implementations, a player convenience input area 118 may be included in the gaming device 100, as is shown in FIG. 1. In various implementations, player convenience input area 118 may have a variety of features and functions depending on the jurisdictional deployment of the gaming device 100. In some implementations, the player convenience input area 118 may house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into the gaming device 100 during play. These player loyalty/player tracking cards may be associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain implementations, the player convenience input area 118 may include player convenience features such as a pocket for storage that allows players to store their personal items such as a mobile phone. The gaming device 100 may include one or more universal serial bus (USB) ports that enables a player to charge their electronics or connect to services such as the Internet or food service. Further, player convenience input area 118 of the gaming device 100 may include buttons to request food or drink service if the gaming device is located in an establishment that has food and drink service. The gaming device 100 may be connected to a local or wide area network such that selection of the requested food or drink service may alert the establishment's hospitality staff to deliver the requested service directly to the gaming device 100.

The layout of the player control button area 114, player value acceptor and dispenser area 116, and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in some implementations, lower cabinet body portion 106 includes the first game display 120, which can be mounted atop or flush with the lower cabinet body portion's top panel surface. The first game display 120 can be, for example, a 27-inch liquid crystal display (LCD) display mounted in a widescreen orientation. However, any suitable display may be used in any suitable orientation. In the illustrated implementation, the first game display 120 can mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In some implementations, gaming device 100 may use one first game display 120 and not include additional game displays (not illustrated).

The lower cabinet body portion 106 can be further constructed to support an upper cabinet portion 126. The upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate conditions of the gaming device 100 to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In some implementations, as illustrated in FIG. 1, gaming device 100 includes additional displays, including a second game display 130 and a third game display 134. The second game display 130 and the third game display 134 can be disposed generally in a vertical relationship and generally in alignment with the first game display 120. Like the first game display 120, the second game display 130 and the third game display 134 can be 27-inch LCD displays and can be mounted in a widescreen orientation in some implementations. However, any suitable display in any suitable orientation may be used for the second game display 130 and the third game display 134. Further, like the first game display 120, the second game display 130 and the third game display 134 can be mounted within and framed by second display frame 132 and third display frame 136, respectively. The second display frame 132 and the third display frame 136 can be attached to the upper cabinet support structure and can protect the second game display 130 and the third game display 134.

The first game display 120, the second game display 130, and the third game display 134 can be disposed at an angle from each other to form a player-facing concave arc. However, in some implementations, the angles between the displays 120, 130, and 134 may be adjustable and may be smaller or greater than the angles illustrated in FIG. 1. Further, it is understood that in some implementations the displays may be disposed in a common plane relative to each other.

It also should be appreciated that in various implementations a variety of display technologies may be utilized equivalently and interchangeably with a variety of implementations of the gaming device. Equivalent display devices include all variations of liquid crystal displays, light emitting diode displays, and plasma displays.

In some implementations, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative implementations, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In some implementations, one or more of the first game display 120, the second game display 130, and the third game display 134 may be fitted with a transparent touch sensitive overlay for sensing player touch inputs into the gaming device 100. The touch sensitive overlays can communicate with a processor of gaming device 100 to enable the player to interact with the game.

In some implementations, the curved displays may be used for any or all of the first game display 120, the second game display 130, or the third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, the second game display 130, and the third game display 134. Additionally, in some implementations flexible display technologies can be used in combination with fixed flat screen technologies.

While the gaming device 100 has been described as implemented with video technologies, in some implementations, mechanical reels with reel strips containing game indicia and step motor controllers may be employed to provide game information to a player. In some implementations, the reel strips may include printed symbols. In another implementation, the mechanical reels may include flexible video display technology as the reel strips on mechanical reels. Thus, games implemented in video form can readily be implemented with mechanical reels utilizing such display technology. Alternatively, in other implementations mechanical reels with reels strips having fixed symbols displayed along the reel strip could be used to implement the game.

Dependent upon the particular gaming device housing style, a variety of other display technologies may be utilized in combination with the gaming device disclosed herein. For example, the gaming device 100 may have one or more display devices in addition to the main game display(s) in some implementations. For example, the gaming device 100 may include a player tracking device having a player tracking display which displays various information to the player regarding the player's status. The gaming device 100 may also include other game-related displays such as the wager display and the gaming credit balance display. These additional game-related displays may be separate display devices or may be displayed on any one or more of the first game display 120, the second game display 130, or the third game display 134.

The gaming device 100 may also include cabinet lighting design functions to attract players. In the example gaming device 100 illustrated in FIG. 1, attractive cabinet lighting is provided by frame accent lighting 138. It is noted that frame accent lighting 138 is a common structure found on the first display frame 122, the second display frame 132, and the third display frame 136 and player interaction area 112. Example areas where frame accent lighting is applied to the gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In some implementations, the circuit boards are flexible circuit boards. These LED strips and transparent or translucent coverings may surround one or more gaming device displays frames, as well as the player interaction area, to highlight these areas.

In some implementations, the individual LEDs mounted on the LED strips are of a type that can emit red, green, and blue light. In an alternative implementation, separate LEDs are used for the light colors. All LED strips can be electrically connected and can be controlled by a cabinet lighting controller (e.g., cabinet lighting controller 218 in FIG. 2) in conjunction with a processor of the gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some implementations, cabinet 104 may include LED strip lighting or LED rope lighting to accentuate the cabinet and enhance the attractiveness of the gaming device 100 to players. LED rope lighting is a number of small light-emitting diode bulbs linked together and encased in a plastic, polyvinylchloride, or other suitable material to create a string of lights. For example, in one implementation illustrated in FIG. 1, cabinet 104 includes cabinet accent lighting 140. In some implementations, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various implementations, gaming device 100 includes one or more audio speakers 142 and appropriate driving electronics and sound cards so that game players may experience pleasing audio aspects of the gaming device 100. Audio is desirable to attract and maintain player interest in gaming device 100. The gaming device 100 may also emit attraction sounds during any idle period of gaming device 100. Game audio may add to the player's enjoyment of gaming device 100 by providing music and sound effects designed to enhance and compliment the gaming experience. In FIG. 1, the audio speakers 142 are shown mounted on the upper corners of second display frame 132. Any suitable number of additional speakers 142 may be provided on additional display frames or on the lower cabinet body portion 106 as desired.

The speakers 142 designed for emitting bass vibrations may be included in some implementations. Placement of the speakers 142 may be selected to enhance the sound emitting characteristics of the gaming device 100. For example, bass speakers or additional speakers 144 may be mounted inside lower cabinet body portion 106. Further, it is envisioned that in some implementations sound processing such as multi-channel processing and surround sound processing are included in gaming device 100. Audio jacks for attachment of player headphones may also be provided in some implementations of gaming device 100 for the player to further enhance the audio experience of the game and also to block out noise from other gaming devices.

In some implementations, the front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing the gaming device 100 in a seated position. Foot rest 148, which may be cushioned, is provided below player interaction area 112 to enhance a player's ergonomic comfort while playing the gaming device 100. In some implementations, the edges of player interaction area 112 may be ergonomically cushioned as well.

The gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary, and/or 3) provide an easy location and support for all necessary player input/output (I/O) interactions, including gaming control interactions and value wagering interactions. For example, in some implementations the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In some implementations, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In some implementations, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
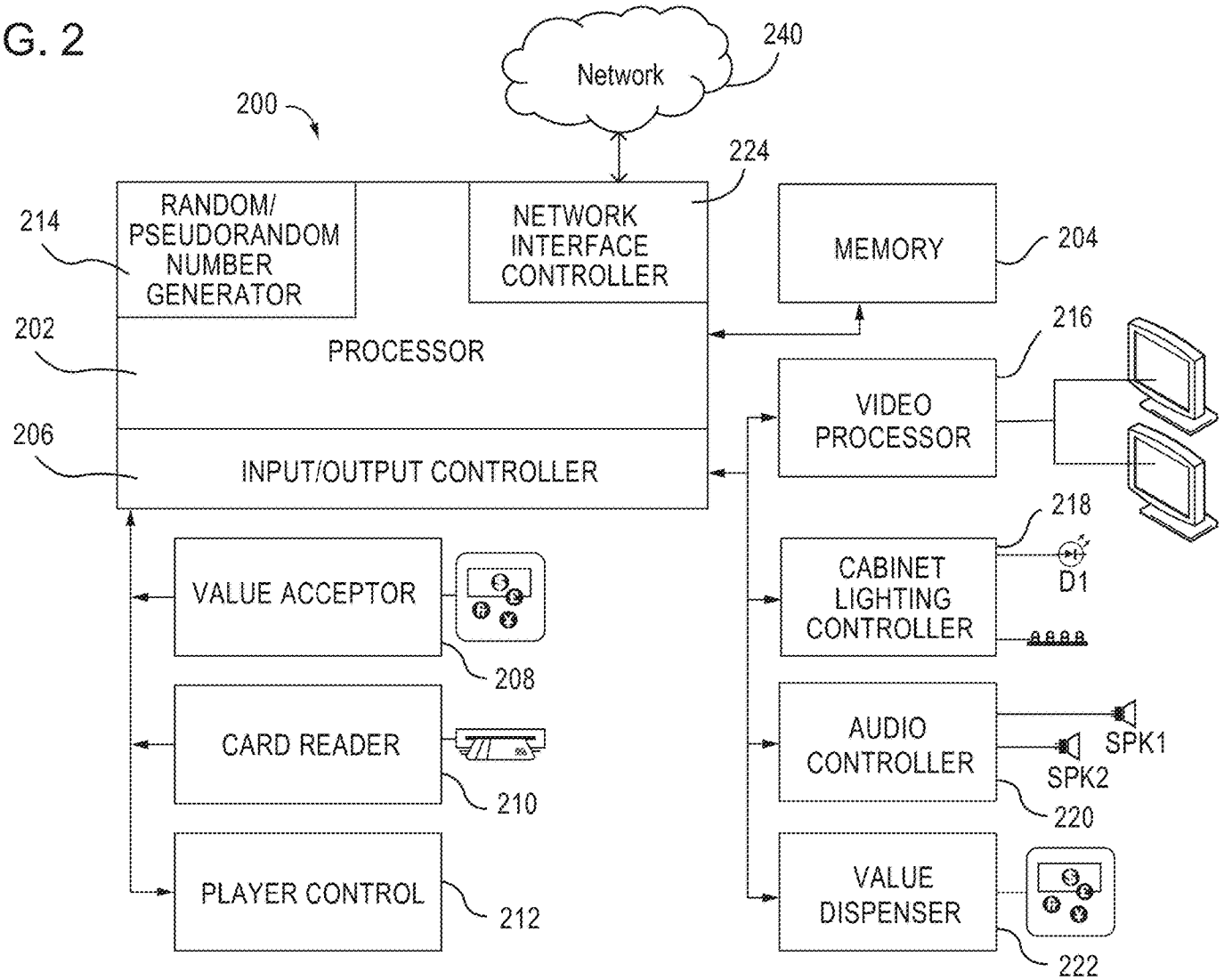
FIG. 2 shows a functional block diagram illustrating an example of gaming device technology components of a gaming system in accordance with aspects of the present disclosure.

FIG. 2 illustrates a functional block diagram of a control unit 200 of a gaming device (e.g., gaming device 100) that are specially configured to carry out the game function and operations described herein. The functional elements shown in FIG. 2 cooperate, on a broad and general level, to function as a gaming device. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In accordance with aspects of the present disclosure, the control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one implementation, the control unit 200 is also configured to communicate with a server device through a network.

In some implementations, the control unit 200 includes at least one specially configured processor 202 or central processing unit (CPU). In some implementations, the specially configured processor 202 includes arithmetic logic units and math co-processors also known as floating point units. In some implementations, the specially configured processor 202 includes registers for holding instructions or other data, and cache memory for storing data for faster operation thereupon. In some implementations, the specially configured processor 202 may be a multi-core processor that includes two or more processors for enhanced performance, more efficient parallel processing, or other advantageous computing functions. In another implementation, the specially configured processor 202 may be one or more processing devices such as microprocessor(s) or integrated circuit(s) and may include one or more controllers. It should be appreciated that in some implementations, a general-purpose processor could be programmed to perform the functions of the specially configured processor 202.

A controller, in some implementations, is a device or a software program that manages or directs the flow of data between two entities. Often, controllers are special purpose circuitry or software that solve a technical communications problem between different technology systems. In some implementations, a controller functions as an interface between two systems while managing the communications between the systems. In another implementation, a controller functions as an interface between a processor and a peripheral device and functions to control the peripheral device.

At least one specially configured processor 202 or controller of control unit 200 may be specially configured to communicate with at least one memory device 204, generally shown as memory device 204 in FIG. 2. In some implementations, the memory device 204 includes one or more memory structures for storing instructions and various types of game data. The memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in some implementations, communication with the memory device 204 by the specially configured processor 202 or a controller, encompasses the processor or controller accessing the memory device 204, exchanging data with the memory device 204, or storing data to the memory device 204.

The memory device 204 may store all program code and game code (collectively the "code"), and operation data necessary for the operation of the control unit 200 providing a gaming device and execution of the gaming features described hereinbelow. In an alternative implementation, game code and operation data necessary for the operation of the control unit 200 may be stored in a distributed manner such that some code is stored in memory device 204 and other code is stored remotely from the control unit 200. In some implementations, the code and operation data necessary for the operation of the control unit 200 includes, for example, basic input and output function data, instruction fetching data, bus and network communication protocol data, and like data necessary for an operational gaming device. In some implementations, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in some implementations, the code and operation data for the operation of the gaming device described above may be stored in removable game cartridges or flash drives, a compact disk ROM, a digital versatile disk (DVD) optical storage technology, or suitable other fixed non-transitory storage mediums. In another implementation, part or all of the code and operational data for operation of the gaming device or for execution of the game features may be stored in a remote memory structure and be downloaded to the memory device 204 via a network connection.

In some implementations, the control unit 200 may utilize any combination of memory devices such as random access memory devices (RAMs), unalterable memory devices (ROMs), and mass storage devices for securely storing and securely communicating the software components or code that facilitate game play and other functions of the control unit 200. The memory devices may store software components or code that include various game data and game related control and execution software. In some implementations, the software components stored in the memory devices 204 may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the control unit 200.

In some implementations, memory devices, such as memory device 204, with the software components and other data may be secured and authenticated by authentication software stored in an unalterable memory device within the housing of the control unit 200. The control unit 200 may also include application specific integrated circuits (ASICs) to perform the security and authentication functions. At any appropriate time, such as before each play of a game, at a predetermined interval, upon transfer of any game data or any software components from a mass storage to the memory device 204, or upon demand, the control unit 200 (using a processor such as processor 202 or a separate ASIC) may execute an authentication routine and perform an authentication of any software component or other data of the control unit 200. In some implementations, the gaming device software components may be prepared for authentication via creation and storage of an encrypted signature unique to one or more of the software components.

In some implementations, an encrypted signature may be created by utilizing a hash function on a software component or code to form a message digest (i.e., a hash of the software component) followed by a key encryption of the message digest to form an encrypted signature unique to the software component. In some implementations, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and the control unit 200 may allow game play to proceed. However, when the message digests do not match, the control unit 200 may determine that the software component under authentication may be corrupted or fraudulent and game play may be halted. It should be appreciated that the control unit 200 may perform other suitable security and authentication checks on the game data or software components. Such authentication and security devices and functions are unique to gaming and casino industry to minimize or prevent fraud in gaming devices and gaming systems.

For a player to interact with a gaming device, the control unit 200 receives and processes player inputs, and the control unit 200 causes processed results to be output or communicated to the player. In some implementations, player inputs are recognized and processed or directed for processing by input/output (I/O) controller 206. Further, I/O controller 206 may process and direct player outputs for communication to the player. The I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for the attached input devices and output devices. In this manner, specially configured processor 202 is freed from the operational details of the peripheral I/O devices. For example, in some implementations where an input or output device is changed or upgraded, the I/O controller 206 can be changed without changing other gaming system components.

In some implementations, a player deposits value into a gaming device by inserting some form of currency into a value acceptor 208 for game play. Alternatively, a player deposits value into a gaming device by inserting an encoded paper ticket into a value acceptor 208 for game play in some implementations. The value acceptor 208 can be combined with a currency reader and validator, and a code reader for reading value encoded on paper tickets. The value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, the specially configured processor 202 processes a player's wagers and determines the amount of credits to debit from the player's credit balance. When a winning outcome is obtained, the specially configured processor 202 is configured to determine the amount of credits to add to the player's credit balance.

As previously mentioned with respect to FIG. 1, a variety of value acceptance arrangements are possible. In some implementations, the value acceptor 208 could include magnetic strip or chip card readers to accept and transfer value. The value acceptor 208 may also be configured to accept and transfer non-traditional currencies such as digital currencies. In these implementations, I/O controller 206, a specially configured processor 202, or both contain appropriate control instructions to communicate and extract value from the inserted item containing value. In some implementations, use of a magnetic strip or embedded chip card, for example a bank card, for value insertion requires the specially configured processor 202 to communicate, via network interface controller 224 (described below), with devices external to a gaming device.

In some implementations, a card reader 210 may be included in gaming device 100 to accept player loyalty cards. For example, card reader 210 can extract account identifying information from the card and utilizes this information to access the associated account information stored remotely via network interface controller 224. In implementations where player loyalty/player tracking systems are employed, a player's loyalty account and record of gaming activity can be stored in a networked storage location or database. The specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various implementations, a player control 212 receives a player's game inputs and communicates the player's game inputs to the specially configured processor 202. The player's game inputs may include, but are not limited to, wager amounts, pay line selections, game control signals, and cash-out signals. The player control 212 may generate signals based on button presses, touch screen activations, or voice control. The player-initiated signals are propagated to the specially configured processor 202 by the I/O controller 206. Further, the player-initiated signals may direct and inform execution of the game instructions stored in the memory device 204 and configured to be executed by the specially configured processor 202.

In some implementations, the specially configured processor 202 is configured to execute stored program code and instructions which generate random numbers or pseudo-random numbers. In some implementations, as illustrated in FIG. 2, a random number generator (RNG) 214 is a software module configured to be executed by the specially configured processor 202 for the generation of a true random or pseudo-random number. The code for RNG 214 may be stored in the memory device 204. The RNG 214 generates random numbers for use by the gaming software during game execution. In some implementations, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various implementations, once random symbols are selected based upon the random number generated by the RNG 214, patterns of symbols are compared to determine wagering outcomes. In an alternative implementation, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another implementation, the random generation of "numbers" or symbols may be performed with electromechanical components. For example, gaming devices such as gaming device 100 may incorporate a mechanical reels rotatable about a common axis. Indicia or symbols may be positioned around the periphery of the reels. The indicia or symbols on the reels may indicate separate detectable reel stop positions. The reels can be set into a spinning/rotation motion by pulling a lever or pushing a button. In some implementations, the gaming device 100 can stop the reels by a gaming device actuating, on a random timing basis, a suitable mechanical or electro-mechanical reel brake. When the reels stop rotating, one or more displayed stop positions of the reels are detected. Since the stop positions are associated with respective indicia or symbols, the gaming device can determine whether the combination of stop positions (i.e., translating to a combination of displayed symbols) results in a winning symbol combination.

Returning to FIG. 2, the control unit 200 controls the function and output of a output devices utilized by a gaming device. In various implementations, I/O controller 206 serves as an interface unit between specially configured processor 202 and output devices such as video processor 216, cabinet lighting controller 218, audio controller 220, and value dispenser 222.

In some implementations, the video processor 216 communicates with specially configured processor 202 to render all game graphics, video displays, and information on one or more video display units (e.g., displays 120, 130, and 134). In some implementations, the video processor 216 includes one or more processors, controllers, and/or graphics cards for processing the game images, outcomes, and animated displays and coordinating the processed data to be display between, among, or across any or all display devices. In various implementations, this may include being configured to simulate objects and the movement of objects which represent video reels containing sets of gaming symbols.

It should be appreciated that in certain other implementations where physical mechanical reels are utilized by the gaming device 100 as a game displays, reel controllers and stepper motors would be provided in lieu of or in addition to video processor 216.

In implementations which utilize cabinet lighting as described with respect to FIG. 1, a cabinet lighting controller 218 may be utilized to coordinate and control the color and timing of cabinet lighting displays with specially configured processor 202. In certain implementations which utilize sound design, specially configured processor 202 may utilize audio controller 220 to coordinate and control the sound emissions. In some implementations, audio controller 220 may include one or more audio processing cards for generating sound and for driving the one, two or more speakers that may be included with a gaming device.

In various implementations, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In some implementations, value dispenser 222 can be controlled to issue the player's credit value using any of the types of value discussed herein. In some implementations, the player's credit value may be issued to the player via a printed and dispensed encoded paper ticket or token which the player can then exchange at a special purpose kiosk or cashier location for the monetary value encoded into the ticket or token. In some implementations, the specially configured processor 202 can direct the value dispenser 222 to issue to the player an appropriate amount of coin or bills directly to the player. Additionally, or alternatively, in some implementations, the player may have the option to electronically direct the credit value to an account associated with the player.

In some implementations, the control unit 200 may communicate with one or more devices outside the gaming device. For example, gaming device 100 may be connected to a larger network 240 via a local area network (LAN) or a wide area network (WAN). The control unit 200 may communicate with one or more central servers, controllers, or remote devices to execute games, establish credit balances, participate in jackpots, etc. In such implementations, network communications and connections are accomplished via a network interface controller 224. Network interface controller 224 can be a digital circuit board or card installed in control unit 200 to provide network communications with external devices.

In some implementations, various additional features and functions are performed by the control unit 200. For example, the control unit 200 may be specially configured with appropriate software to track all game play events that occur on a gaming device. In some implementations, the control unit 200 may audit all recorded monetary transactions, including all wager amounts, game outcomes, game winnings, and game payouts that occur through the value dispenser 222. Further, some implementations may include security software to assist in protecting the gaming device 100 from tamper or alteration attempts.

Gaming System Operation

The flowcharts in FIGS. 3A-3D illustrate functionality and operation of possible implementations of systems, devices, methods, and computer program products according to various implementations of the present disclosure. Each block in the flow diagrams of FIGS. 3A-3D can represent a module, segment, or portion of program instructions, which includes one or more computer executable instructions for implementing the illustrated functions and operations. In some alternative implementations, the functions and/or operations illustrated in a particular block of the flow diagram can occur out of the order shown in FIGS. 3A-3D. For example, two blocks shown in succession can be executed substantially concurrently, or the blocks can sometimes be executed in the reverse order, depending upon the functionality involved. It will also be noted that each block of the flow diagram and combinations of blocks in the block diagram can be implemented by special purpose hardware-based systems that perform the specified functions or acts, or combinations of special purpose hardware and computer instructions.

Figure 3A:
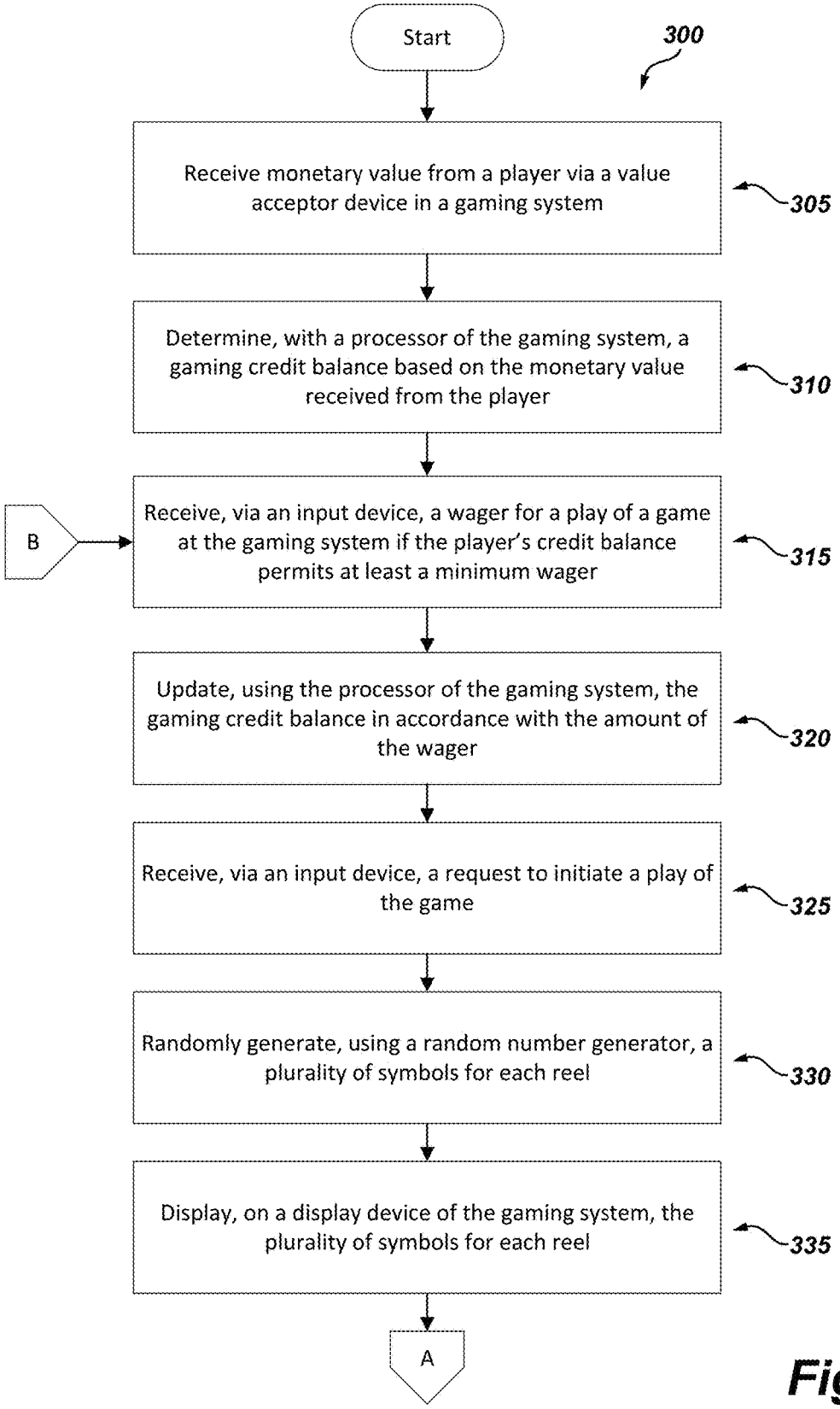
FIGS. 3A, 3B, 3C, and 3D show a process flow diagram illustrating an example method of operating the gaming system providing symbol storage in accordance with aspects of the present disclosure.
Figure 3B:
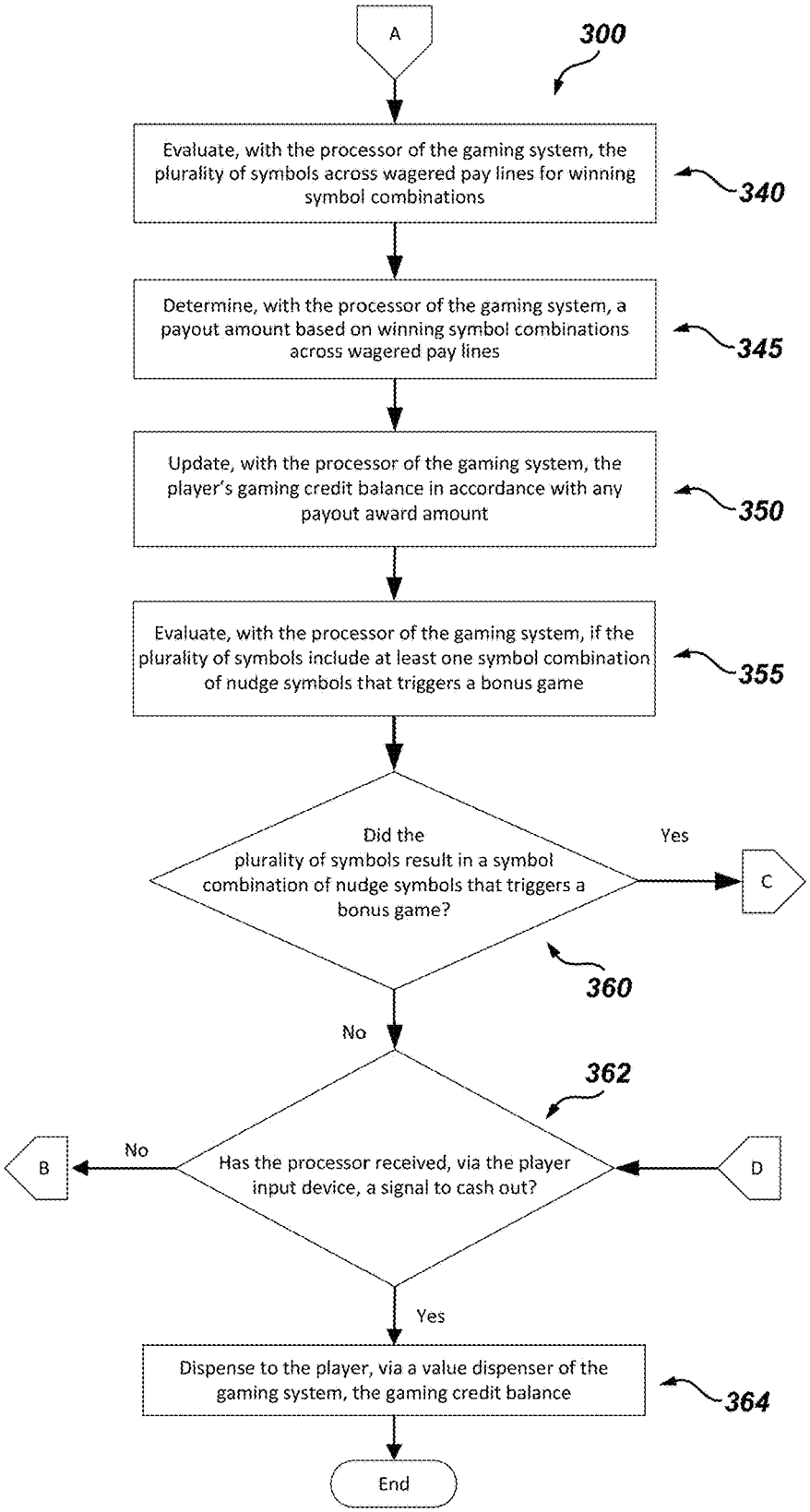

FIGS. 3A-3D show a process flow diagram illustrating an example of method 300 of operating the gaming system (e.g., gaming device 100) providing symbol storage in accordance with aspects of the present disclosure. FIGS. 3A and 3B describe parts of a base or primary game while FIGS. 3C and 3D describe parts of a bonus game. However, it should be appreciated that FIGS. 3C and 3D may be integrated as part of a base game without entering a separate bonus game.

In some implementations, one or more processors (e.g., processor 202) of the gaming system are configured, via instructions stored in a memory device, to perform the operation 300. However, it should be appreciated that other suitable variations of operation 300 are possible. For example, in some implementations, fewer or one or more additional blocks (not shown) may be employed in operation 300 of the gaming system and method. In other implementations, the blocks may be performed in any suitable order.

FIG. 3A illustrates one implementation in which the gaming system receives a monetary value from a player to initiate operation 300. As indicated in block 305, the gaming system may receive monetary value via a value acceptor device associated with the gaming system. The value acceptor device, in some implementations, is disposed in a gaming system or in communication with the gaming system as discussed above. In some implementations, the gaming system determines a credit balance based on the monetary value received from the player at a value acceptor device as indicated in block 310. The gaming system determines, via a processor, a gaming credit balance for the player. The gaming credit balance may be based on the monetary value received from the player at the value acceptor device.

In some implementations, the gaming system may receive a wager for a play of a game at the gaming system. In some implementations, a play of a game begins with a wager and activation of a game and the play of the game ends when the features of the base, bonus, or both have completed (depending on whether a bonus game is played). In another implementation, one play of a game comprises the processor executing blocks 325-390, and terminating at either block 360 or 390 depending on whether the gaming system activates a bonus game. In some implementations, block 362 and block 364 are not part of a play of a game.

Block 315 of FIG. 3A illustrates an implementation where the player's wager is received via a player input device. The gaming system may allow a player to place a minimum wager, a maximum wager, or any suitable wager amount. In some implementations, the player's wager amount may determine the value of some of the available awards. Depending on the wager amount, the gaming system may also enable the player to select pay lines across displayed symbol positions (e.g., symbol display areas) on reels in a game in which to place wagers. Although in some implementations, the gaming system selects the wagered pay lines automatically based on the player's wager. Wagered pay lines may be referred to herein as active pay lines. In some implementations, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system.

In some implementations, the gaming system may use a processor of the gaming system to update a gaming credit balance of the player. The player's credit balance may be updated in accordance with the player's wager amount as indicated in block 320. In some implementations, the credit balance is not updated until a later time.

Block 325 illustrates one implementation in which the gaming system may receive a request to initiate a play of a game. The request to initiate the play of the game may be received from a player via a player input device in communication with the gaming system. The gaming system may securely access game data from a memory device and execute an authentication routine on the game data to start a play of a game as discussed above. For example, the player may press a spin button on the gaming system to start spinning slot machine reels of the gaming system (or randomly generating symbols using other methods discussed above for virtual reels) for the play of the game. It should be appreciated that reels or slot machine reels used throughout the specification may refer to mechanical reels, electromechanical reels, or virtual video reels (where virtual reels strips or no reel strips are used). It should further be appreciated that although many examples illustrated in the specification describe the games in terms of slot machines with reels, other games may be used, including games without slot machine reels.

In some implementations, the gaming system may use a random number generator to randomly generate symbols from sets of symbols as indicated in block 330. In some implementations, the gaming system may generate the symbols for display on a set of reels (or virtual reels). In some such implementations, the reels are associated with respective sets of symbols (e.g., symbol sets). As used herein, the random number generation may refer to pseudo-random or true-random number generation depending on the module used for the random number generation.

In some implementations, the gaming system may cause a display device to display the symbols generated as indicated in block 335. In a game using reels, the gaming system may display the generated symbols in visible symbol display areas of the individual reels. Off page connector A refers to FIG. 3B to continue operation 300.

Turning now to FIG. 3B and off page connector A, in some implementations as shown in block 340, the gaming system evaluates the generated symbols across active or wagered pay lines for winning symbol combinations. In some implementations, the gaming system evaluates the winning symbol combinations based on the pay lines wagered upon by a player. The gaming system may evaluate the player selected pay lines, gaming system assigned pay lines, or pay lines assigned as active in some other manner for the play of the game. In some implementations using reels, the gaming system determines an award amount based on winning symbol combinations formed across the reels on active pay lines. For example, if a pay table associated with the gaming system indicated that at least three of the same bar symbols is a winning symbol combination and awards a predetermined payout, the gaming system would evaluate the generated symbols for bar symbols. If the gaming system generated at least three bar symbols on adjacent reels and along an active pay line, the gaming system may determine that the three bar symbols is a winning symbol combination based on the predetermined pay table. It should be appreciated that a pay table may include any suitable number of winning symbol combinations and payouts. In some implementations, a pay table may indicate that as few as one symbol may be associated with a payout. Alternatively, two or more symbols may be used to form winning symbol combinations that result in a payout.

In block 345, the gaming system determines, with the processor, a payout amount based on the evaluated winning symbol combinations across wagered pay lines. As illustrated in block 350, the gaming system may update, with the processor, the player's gaming credit balance in accordance with any award amount. As noted above, the blocks illustrated in FIGS. 3A-3D can be rearranged in any suitable order. As such, it should be appreciated that the gaming system may update player's gaming credit balance at other suitable times.

In some implementations, as indicated in block 355, the gaming system evaluates the symbols for at least one symbol combination of predetermined symbols (such as nudge symbols) that triggers a bonus game. It should also be appreciated that in some implementations, events other than generating one or more of a predetermined symbol may trigger the bonus game. If the gaming system determined that the generated symbols did not result in triggering a bonus game, in block 360, operation 300 moves to block 362. In some implementations, as indicated in block 362, the gaming system may receive a signal to end game play or "cash out" via an input device of the gaming system (which would end the gaming session). In such a situation, the gaming system dispenses a value to the player, through a value dispenser, based on the player's gaming credit balance as illustrated in block 364 and operation 300 ends.

On the other hand, if the gaming system processor has not received a signal to end game play (e.g., the player continues a gaming session to play another play of the game) via the player input device, the process of operation 300 returns to block 315 via off page connector B. The gaming system may receive, via a player input device, a wager for another play of the game and continue operation 300 from block 315. However, in some implementations, the wager may not be accepted if the player has fewer credits than the player's selected wager amount, as shown in block 315.

Figure 3C:
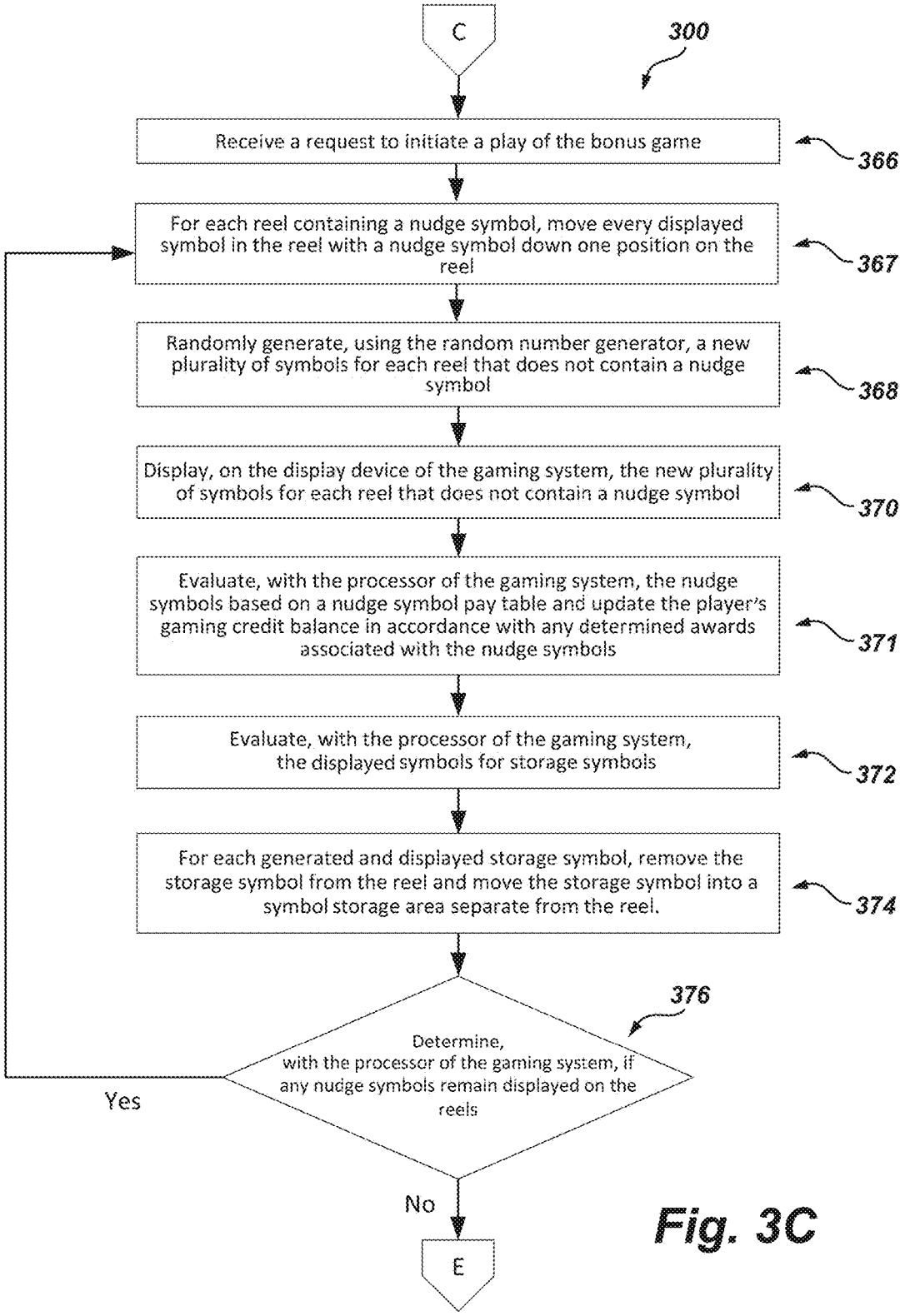

Returning now to block 360, if the gaming system determined that the generated symbols resulted in triggering a bonus game (e.g., a predetermined quantity of nudge symbols that evaluate as a scatter symbol combination), operation 300 moves to block 366 in FIG. 3C via off page connector C. In some implementations, if the gaming system determines that the generated symbols includes one or more generated predetermined symbols, the gaming system may trigger or activate the bonus game. In alternative implementations, the predetermined symbol serves a plurality of game functions. Other suitable game functions may be associated with the predetermined symbol. In some implementations, the predetermined symbol can be any suitable symbol. For purposes of this disclosure, the predetermined symbol is also referred to herein as a nudge symbol.

In some implementations, the gaming system alters the play of the game during the bonus game. In some implementations, the gaming system may change how one or more of the symbols operate. For example, in some implementations, the gaming system alters the nudge symbol such that the nudge symbol does not trigger a bonus game once a bonus game has begun. In some implementations, the gaming system changes the nudge symbol such that it functions as a pay symbol, causes reels to nudge, controls which reels can be re-spun (or obtain a new generation of symbols), and controls whether the bonus game can continue. In some implementations, the gaming system adds additional symbols to the symbol sets used for the bonus game. For example, the gaming system may add one or more storage symbols to one or more symbol sets that the gaming system uses to generate symbols during the play of the game. In some implementations, the quantity of storage symbols added to one or more of the symbol sets upon activating the bonus game ranges from zero to a quantity equal to the quantity of the symbol display areas. However, any suitable quantity of storage symbols can be added to one or more of the symbol sets.

In some implementations, the gaming system may use different pay tables in the bonus game to determine winning outcomes. In some implementations, the gaming system changes the pay table for the bonus game. In some implementations, the altered pay table reduces the quantity of symbols that could result in awards during the bonus game. In some implementations, the pay table indicates two levels of available bonus awards (e.g., a mini bonus and a medium/medi bonus). In some implementations, these two levels of bonus awards are associated with different award values based on what a player wagered for a play of a base game. In some implementations, the gaming system includes a pay table for nudge symbol combinations. In some implementations, the gaming system is configured with an internal jackpot value that varies and can be any suitable range of values (e.g., 15,000 credits to 100,000 credits, or other suitable range). In some implementations, the gaming system is configured with a linked jackpot (e.g., a jackpot based on a network gaming machines that uses portions of player wagers to increase the jackpot; provided that other suitable jackpot funding strategies can be used) with a variable range of values (e.g., 1,000,000 credits to 2,000,000 credits, or other suitable range). Some example data structures that form bonus game pay tables are illustrated in FIG. 5. The illustrated data structures are merely examples. It should be appreciated that any suitable pay tables can be used for the bonus game.

Block 366 of FIG. 3C illustrates one implementation in which the gaming system may receive a request to initiate a play of the bonus game. As noted above, the features discussed in connection with FIG. 3C can also be applied to primary games or games that are not bonus games. The request to initiate the play of the bonus game may be received from a player via a player input device in communication with the gaming system. For example, the player may press a spin button on the gaming system to start randomly generating symbols for the play of the bonus game. In an alternative implementation, the processor of the gaming system may automatically initiate the play of the bonus game and randomly generate symbols for the play of the bonus game.

In some implementations, the bonus game begins with the same symbols that were generated in the base game. In some implementations, the gaming system shades or obscures displayed symbols that are not nudge symbols or storage symbols during the bonus game. In some implementations, the gaming system may completely obscure displayed symbols that are not nudge symbols or storage symbols during the bonus game.

In some implementations, the gaming system evaluates the individual reels for nudge symbols. In some implementations, a nudge symbol causes a reel to nudge one or more symbol display areas. In some implementations, as indicated in block 367, for the reels containing a nudge symbol, the gaming system moves the displayed symbol in the respective reel with a nudge symbol down one position on the reel. For example, the gaming system may rotate the reel one virtual stop position. By rotating the reel one virtual stop position, the gaming system may reveal one new symbol for the reel and cause one displayed symbol to be removed from view. Alternatively, the gaming system shifts the symbols for the reel up or down, whereby the gaming system removes one displayed symbol on the reel from view and generates and displays one new symbol for the reel. It should also be appreciated that in some implementations, the gaming system may rotate the reel less than one virtual stop position or more than one virtual stop position.

In some implementations, the gaming system randomly generates, using an RNG, new symbols for the reels that do not contain a nudge symbol as indicated in block 368. Thus, in some implementations, a nudge symbol prevents the gaming system from generating replacement symbols for reels displaying a nudge symbol. The gaming system displays, on the display device of the gaming system, the new symbols for the reels that do not contain a nudge symbol, as indicated in block 370. By displaying the new symbols for the reels that do not contain a nudge symbol, the gaming system replaces the previously displayed symbols on such reels, respectively. It should be appreciated that the displayed symbols now represent a composite of symbols generated at different times. Such a composite of the displayed symbols may be referred to herein as the currently displayed symbols.

In some implementations, the gaming system evaluates, with the processor, the displayed nudge symbols based on a nudge symbol pay table as illustrated in block 371. If the displayed nudge symbols match with a winning symbol combination on the pay table, the gaming system may update the player's gaming credit balance in accordance with any determined awards associated with the nudge symbol in some implementations.

In some implementations, the gaming system also evaluates, with the processor, the displayed symbols for storage symbols as indicated in block 372. As noted above, the gaming system added storage symbols to one or more of the symbol sets in the bonus game. In some implementations, the storage symbols can also be included in symbol sets for the base game.

In some implementations, the gaming system moves one or more of the displayed storage symbols to a symbol storage area, where the symbol storage area is separate from the reels displaying the storage symbols as illustrated in block 374. In some implementations, the gaming system moves all of the displayed storage symbols to the symbol storage area. In some such implementations, the reels that previously displayed storage symbols may show blank spaces where the moved storage symbols were previously displayed. In some implementations, the symbol storage area includes a symbol display areas. In some implementations, the quantity of symbol display areas in the symbol storage area is equivalent to symbol display areas for the reels. In some implementations, symbols display area in the symbol storage area respectively correspond to the symbol display areas for the reels. In such implementations, when the gaming system moves a storage symbol from a reel, the gaming system places the storage symbol in a symbol display area of the symbol storage area that is associated with the symbol display area of the reel. It should be appreciated that the gaming system may determine which of any displayed storage symbols to move based on a random selection or certain predefined conditions. For example, the gaming system may randomly select one or more of the storage symbols to move and store in the symbol storage area. In another example, the gaming system may move one or more of the storage symbols where displayed storage symbols are in predetermined or randomly determined rows or columns of the reels. In some implementations, the symbol storage area is located on a second display screen of the gaming system.

In some implementations, after the storage symbols have been moved to the symbol storage area, the gaming system may cause symbols positioned above the moved storage symbols to slide or fall to the empty symbol display areas of the reels. The gaming system may also display new symbols in any remaining empty spaces of the reels above where the symbols slid or fell. The new symbols may have been previously generated and stored in memory or the gaming system may generate the new symbols when empty spaces are created.

At block 376, the gaming system determines if any nudge symbols remain displayed on the reels. In some implementations, if a nudge symbol remains displayed on the reels, the gaming system returns to block 367 and repeats blocks 367-376. In some implementations, the gaming system continues to repeat blocks 367-376 so long as the gaming system determines that at least one nudge symbol is displayed. Thus, as noted above, a nudge symbol may cause the gaming system to continue the bonus game and cause the gaming system to continue to generate new symbols for reels that do not display a nudge symbol.

Figure 3D:
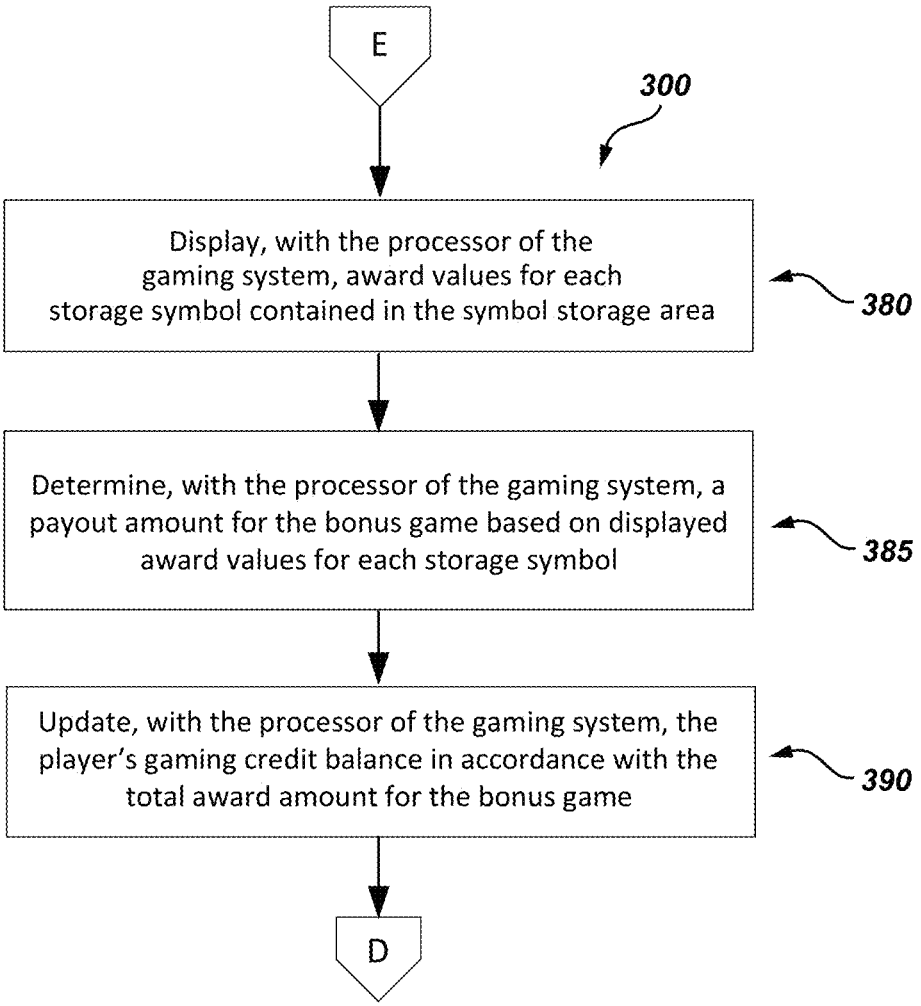

Alternatively, if the gaming system determines that no nudge symbols remain displayed on the reels, the gaming system moves to FIG. 3D via off page connector E.

In FIG. 3D, block 380 illustrates one implementation where the gaming system converts the storage symbols displayed in the symbol storage area into storage symbol award values and displays such storage symbol award values. In some implementations, the gaming system randomly generates the storage symbol award values from a set of award values for the conversion. In some implementations, the set of award values includes numeric awards. In some implementations, the numeric awards are fix numeric awards that do not change based on game inputs. In some implementations, the set of award values includes numeric awards, bonus awards, internal jackpot awards, linked jackpot awards, or some combination of the forgoing. In some implementations, the bonus awards change based on the player's wager, while the internal jackpot and linked jackpot may change based on wagers over time. In some implementations, the gaming system selects the storage symbol award values at the end of the last bonus round for the game. In alternative implementations, the gaming system selects the storage symbol award values at any suitable time before or during the play of the game. It should be appreciated that in some implementations, a play of the game may include one or more bonus rounds. For example, a bonus round may include blocks 367-376 and each loop of these may block another bonus round. When the answer to the inquiry at block 376 is no, the final bonus round ends and gaming system moves to determine the player's award for the bonus game (which is part of the play of the game).

At block 385, the gaming system determines a payout amount for the bonus game based on the displayed storage symbol award values for converted storage symbol in the storage symbol display area.

In block 390, the gaming system, using the processor, updates the player's gaming credit balance in accordance with any award amount for the bonus game (which ends the play of the game) and may proceed to off page connector D and return to block 362 in FIG. 3B.

As indicated in block 362, the gaming system may receive a signal to end game play or "cash out" via an input device of the gaming system. In such a situation, as illustrated in block 364, the gaming system dispenses a value to the player through a value dispenser based on the player's gaming credit balance and operation 300 ends.

On the other hand, if the gaming system processor has not received a signal to end game play via the player input device, the process of operation 300 returns to block 315 via off page connector B. The gaming system may receive, via a player input device, a wager for another play of the game and continue operation 300 from block 315. However, in some implementations, the wager may not be accepted if the player has fewer credits than the player's selected wager amount as shown in block 315.

Figure 4A:
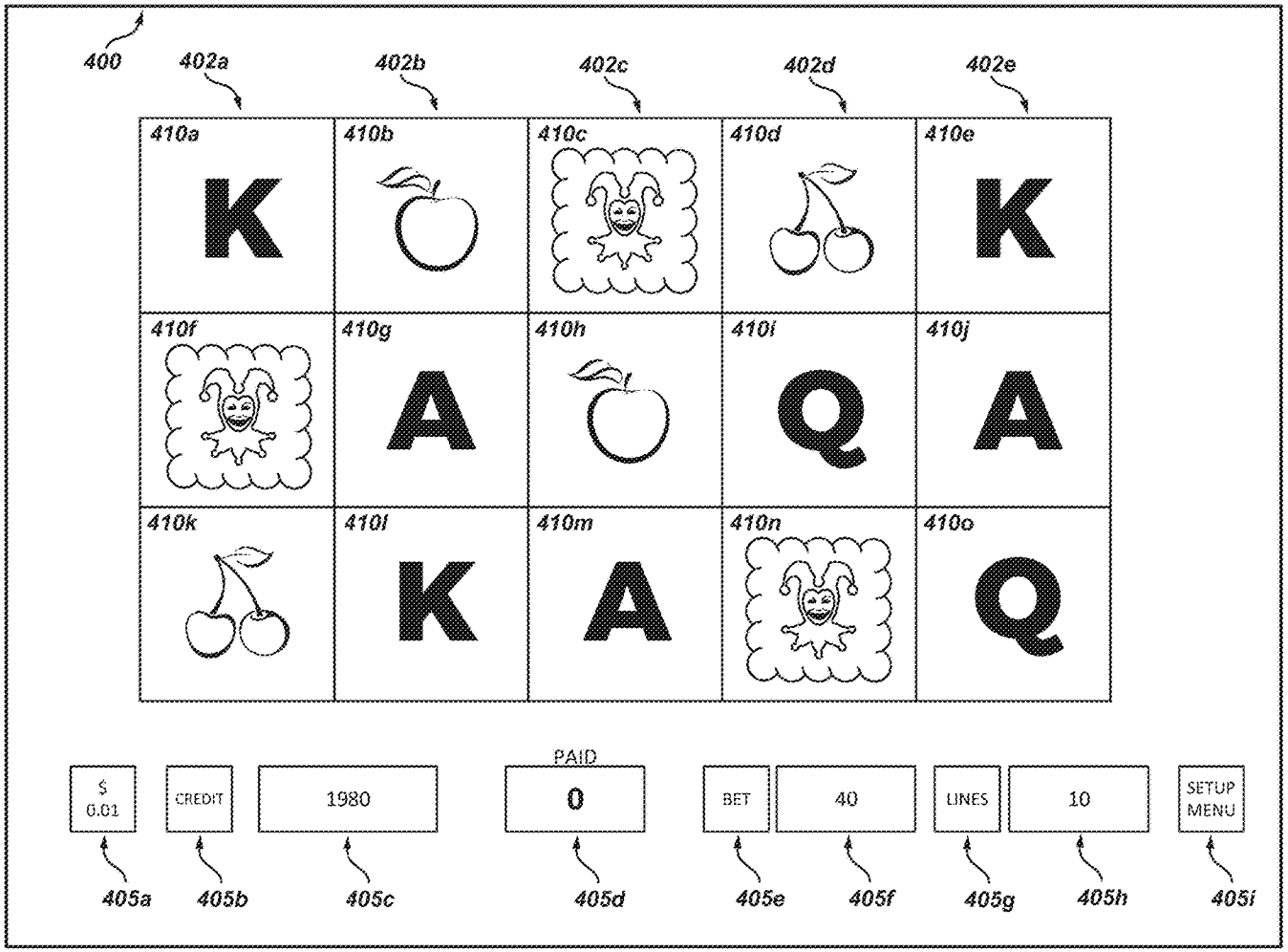
FIGS. 4A, 4B, 4C, 4D, 4E, 4F, 4G, 4H, 4I, 4J, 4K, and 4L show a picture of a gaming system display illustrating an example symbol storage in accordance with aspects of the present disclosure.

FIGS. 4A-4L show pictures of a gaming machine display illustrating an example symbol storage in accordance with aspects of the present disclosure. More specifically, FIGS. 4A-4L illustrate screen shots of one implementation of a gaming system storing symbols to obtain enhanced awards. FIG. 4A illustrates one implementation of a game display 400 that the gaming device 100 may display on a display device of the gaming system. In some implementations, game display 400 may be displayed on first display 122 of gaming device 100 illustrated in FIG. 1. However, any other suitable display may be used. The game display 400 displays a set of a virtual video slot machine reels 402*a*, 402*b*, 402*c*, 402*d*, and 402*e* as illustrated in FIG. 4A for a primary or base game. As also illustrated in FIG. 4A, the reels 402*a*-402*e* are displayed substantially side by side. It should be appreciated that reels 402*a*-402*e* can be displayed with any suitable amount of separation or no separation. It should be appreciated that the game shown in game display 400 is merely representative and may have more or fewer game elements (e.g., reels, symbol display areas, symbols, etc.) shown in the game display 400. It should also be appreciated that other games may be used for the primary or base game.

The reels 402*a*-402*e* are respectively associated with a set of symbols, where the set of symbols includes a number of symbols. The sets of symbols can be associated with the same or different symbols. The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the set of symbols may include pay symbols and special or designated symbols. In some implementations, at least one predetermined symbol is a triggering symbol for a bonus game. In some implementations, at least one triggering symbol must be generated on the reels during a play of a game to trigger the bonus game. In some implementations, triggering symbols must be generated on the reels during a play of a game to trigger the bonus game. In some implementations, any one of the symbols in the sets of symbols can be designated as the predetermined triggering symbol. The triggering symbol may be associated with one function (e.g., triggering a bonus game), but may alternatively be associated with a plurality of different game functions. The triggering symbol may be a scatter symbol in some implementations. In some implementations, the triggering symbol is a scatter symbol and a nudge symbol. In some implementations, the gaming system alters the nudge symbol between the base game and a bonus game such that the nudge symbol does not trigger a bonus game once a bonus game has begun. In some implementations, the gaming system changes the nudge symbol in the bonus game such that the nudge symbol can function as a pay symbol, causes reels to nudge, controls which reels can be re-spun (or obtain a new generation of symbols), controls whether the bonus game can continue, or some combination of some or all of the forgoing. In some implementations, the gaming system adds additional symbols to the symbol sets used for the bonus game. For example, the gaming system may add one or more storage symbols to one or more symbol sets that the gaming system uses to generate symbols during the play of the game.

Returning now to FIG. 4A, the game display 400 depicts a plurality of symbol display areas (also referred to herein as symbol display positions) 410*a*, 410*b*, 410*c*, 410*d*, 410*e*, 410*f*, 410*g*, 410*h*, 410*i*, 410*j*, 410*k*, 410*l*, 410*m*, 410*n*, and 410*o*. These plurality of symbol display areas can be associated in a manner that provides the appearance of game reels. It should also be appreciated that the symbol display areas may not be associated with game reels in some implementations. As illustrated in FIG. 4A, symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o* are associated in a manner that provides the appearance of a set of five slot machine game reels. In some implementations, the plurality of symbol display areas that provide the appearance of five game reels may be arranged in a manner that visibly shows three symbol positions of each of the five game reels. For example, the symbol display areas 410*a*-410*o* are each associated with positions on reels 402*a*-402*e*, respectively. As shown in FIG. 4A, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; and symbol display areas 410*d*, 410*i*, and 410*n* are associated with reel 402*d*; and symbol display areas 410*e*, 410*j*, and 410*o* are associated with reel 402*e*. The arrangement illustrated in the implementation of FIG. 4A thus creates a visible display area of the reels 402*a*-402*e* comprising three visible symbol positions for each reel. When viewed together, reels 402*a*-402*e* appear like a 3-row by 5-column reel array in display 400. In other implementations, smaller or larger visible areas of the reels can be displayed. That is, the reels 402*a*-402*e* may show fewer or a larger number of visible symbol display areas. In some implementations, some symbol display areas can be hidden to hold generated symbols for use when the reels are nudged, as is discussed herein. While symbol display areas are illustrated with defined boxes, it should be appreciated that in some implementations, the defined boxes are not visible to the player. It should also be appreciated that in some implementations, the symbol display areas are other shapes or not defined shapes and may not be associated with reels.

Each reel 402*a*-402*e* may display a plurality of symbols that the gaming system generates from the sets of symbols in their respective symbol display areas as illustrated in FIG. 4A. In some implementations, the individual reels may be shown spinning in one direction to simulate slot machine reels. However, it should be appreciated that the reels may be shown spinning in any suitable direction. The reels may also be shown spinning in different directions in some implementations.

Game display 400 also includes several information areas and buttons 405*a*-405*i*. These information areas and buttons 405*a*-405*i* are illustrated in a particular arrangement, but may be arranged in any suitable manner in different implementations. In some implementations, game display 400 may include more or fewer display areas and buttons 405*a*-405*i* than illustrated. Information area 405*a* illustrates an example value of one credit for the game displayed in game display 400. Information areas 405*b* and 405*c* illustrate an example of the amount of the player's available credits. Information area 405*d* illustrates the amount of credits a player has won. Because FIG. 4A illustrates the start of a play of a game, the information area 405*d* shows zero credits have been won. Button 405*e* illustrates a software button that the player can select to place a bet or wager. It should be appreciated that the functionality of button 405*e* may also be replicated or replaced with a hardware button on the gaming device 100. Information area 405*f* illustrates that the player has selected to wager 400 credits. Button 405*g* illustrates a software button that the player can select to determine how many pay lines to wager on. It should be appreciated that the functionality of button 405*g* may also be replicated or replaced with a hardware button on the gaming device 100. Information area 405*h* illustrates that the player selected to wager on 10 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on the play of the game. The gaming system may provide a visual indication of the player's credit balance to the player as discussed above in information area 405*c*.

To initiate the play of the game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time. In some implementations, the gaming system may use other methods to determine winning symbol combinations in addition to or without pay lines. For example, the gaming system may evaluate generated and displayed symbols for scatter pay symbols, ways pays, etc. In some implementations with ways pays, the gaming system can determine a payout amount based on the gaming system generating one or more predetermined symbols on consecutive reels where the predetermined symbols are adjacent. In some implementations with way pays, the gaming system does not require pay line selections.

Upon receipt of the player's wager and activation of the game start button, the gaming system may show a display of spinning reels for each of the reels 402*a*-402*e*. The spinning may appear to occur in a vertical top to bottom direction or in a vertical bottom to top direction (not shown), or in a combination of vertical directions (not shown). In some implementations, the gaming system randomly generates symbols from the associated sets of symbols for reels 402*a*-402*e*, respectively. As noted above, the gaming system may rely on random generation performed by a pseudo RNG, a true RNG, or hardware RNG specifically designed for gaming systems. In some implementations, the gaming system may also update the player's credit meter (information area 405*c*) to reflect the player's available credit balance. As shown in FIG. 4A, the player's credit meter (information area 405*c*) was decremented by 400 credits from 2380 to 1980 to reflect the 400 credit wager the player placed for the play of the game.

The gaming system displays the generated symbols 420*a*-420*o* in symbol display areas 410*a*-410*o* as illustrated in FIG. 4A. Symbols 420*a*-420*o* displayed on reels 402*a*-402*e* illustrate the randomly generated symbols from the set of symbols after the reels have stopped spinning. As illustrated in FIG. 4A, the gaming system randomly generated and displayed symbols in symbol display areas 410*a*-410*o* for reels 402*a*-402*e*.

As illustrated in FIG. 4A, the gaming system generated and displayed King symbols in symbol display areas 410*a*, 410*e*, and 410*l*; Apple symbols in symbol display areas 410*b* and 410*h*; Joker symbols in symbol display areas 410*c*, 410*f*, and 410*n*; Cherry symbols in symbol display areas 410*d* and 410*k*; Ace symbols in symbol display areas 410*g*, 410*j*, and 410*m*; and Queen symbols in symbol display areas 410*i* and 410*o* in the game display 400. It should be appreciated that the displayed symbol combinations are merely for explanatory purposes and the gaming system may randomly generate any suitable combination of symbols based on defined symbol sets associated with the reels 402*a*-402*e*. In this implementation, the Joker symbols are designated as a scatter symbol and a bonus triggering symbol. In the bonus game, the gaming system converts the Joker symbols to nudge symbols and scatter pay symbols. In this implementation, the base game does not include storage symbols, but the gaming system may add one or more storage symbols to the symbol sets for the bonus game. In some implementations as illustrated herein, the storage symbols are Treasure symbols.

FIG. 4A further illustrates one implementation of a gaming system executing an evaluation of the generated symbols on reels 402*a*-402*e* for winning symbol combinations. As noted above, the player may have wagered on one or more pay lines (such as 10 pay lines shown in information area 405*h*). In some implementations, at least the active (wagered on pay lines) are evaluated for winning symbol combinations. Any suitable number of pay lines may be used to evaluate winning symbol combinations.

In the implementation illustrated in FIG. 4A, the gaming system evaluated the generated symbol combinations for winning symbol combinations. In FIG. 4A, the gaming system determined that no winning symbol combinations are displayed across wagered pay lines.

As noted at block 355 of FIG. 3B, in some implementations, the gaming system may also evaluate the generated symbols on reels 402*a*-402*e* for triggering symbols that trigger a bonus game. In this implementation, a bonus game is triggered when at least three nudge symbols (e.g., Joker symbols) are generated anywhere on the reels (e.g., scatter symbols). Returning to FIG. 4A, the gaming system determined that three Joker symbols were generated for the play of the game. In the illustrated implementation, the Joker symbol was designated as the bonus game triggering symbol. It should be appreciated that any other suitable symbol could be designed as the bonus game triggering symbol. In some implementations, more than one different symbol can be designated as a bonus triggering symbol. In some implementations, a combination of different triggering symbols along a pay line may be required to trigger a bonus game. In some implementations, a predetermined quantity of scatter symbols can be used as a bonus game trigger. In some implementations, the gaming system may highlight the Joker symbols in some manner so that player understands that the player won a bonus game or other game features. It should be appreciated that the gaming system may highlight the bonus triggering symbol in any suitable manner. It should also be appreciated that the gaming system may not highlight the bonus triggering symbols in some implementations, as is illustrated in FIG. 4A.

In some implementations, the gaming system may be required to generate more than one bonus triggering symbol to activate a bonus game. In other implementations, the features available in the bonus game may depend on the quantity of bonus triggering symbols that the game system generates. In some implementations, at least one bonus triggering symbol may operate as a modified scatter symbol. That is, in some implementations, at least one bonus triggering symbol must be generated in the far most reel 402*a* (in any symbol display area) to trigger the bonus game. For example, in some implementations, if the at least one bonus triggering symbol is generated in reels 402*b*, 402*c*, 402*d*, or 402*e*, the gaming system may not activate the bonus game. However, in other implementations, the bonus triggering symbol may appear on any reel in any symbol display area to trigger the bonus game. In some implementations, the gaming system may evaluate the bonus triggering symbols from a left to right direction along the reels. In some implementations, the gaming system may evaluate the bonus triggering symbols from a right to left direction along the reels.

Returning to FIG. 4A, the gaming system determined that three bonus game triggering symbols (the Joker symbols) were generated on reels 402*a*, 402*c*, and 402*d* in their respective symbol display areas 410*f*, 410*c*, and 410*n*. Based on the generated bonus triggering symbols in a scatter formation, the gaming system activates a bonus game. In some implementations, the gaming system may execute the play of the bonus game as discussed in corresponding FIGS. 3C and 3D.

In some implementations, the gaming system adds at least one symbol to at least one of the symbol sets for the bonus game. In the implementations described below, the gaming system adds a Treasure symbols (e.g., storage symbols) to a plurality of the symbol sets for the bonus game. In some implementations, the Treasure symbols have no value. In some implementations, the gaming system converts the Treasure symbols to randomly selected or predetermined storage symbol award values. The variations of the storage symbol award values were previously described above in connection with FIGS. 3A-3D. In some implementations, the gaming system uses the same or similar symbol sets associated with the same reels for both the primary game and the bonus game. As discussed herein, in some implementations, the gaming system may add symbols such as the storage symbols (e.g., Treasure symbols) to one or more of the symbol sets. In some implementations, the gaming system changes the pay table for the bonus game. In one such implementation, the gaming system includes a pay table for nudge symbols and a pay table of storage symbol award values that are used for converting Treasure symbols into storage symbol award values. For example, the gaming system includes a pay table that provides pays for nudge symbols in scatter combinations and a listing of possible storage symbol award values. It should be appreciated that the pay table can be modified to include any suitable values and symbol combinations. In some implementations, the gaming system does not include a pay table for symbols other than the nudge symbols and the storage symbols for the bonus game. As such, the gaming system shades or obscures displayed symbols that are not nudge symbols or storage symbols for the duration of the bonus game because these symbols do not result in pay awards. In some implementations, the gaming system may not shade or obscure these symbols. Alternatively, in some implementations, symbols that are not nudge symbols or storage symbols may be listed in a pay table with associated awards for symbol combinations.

Figure 4B:
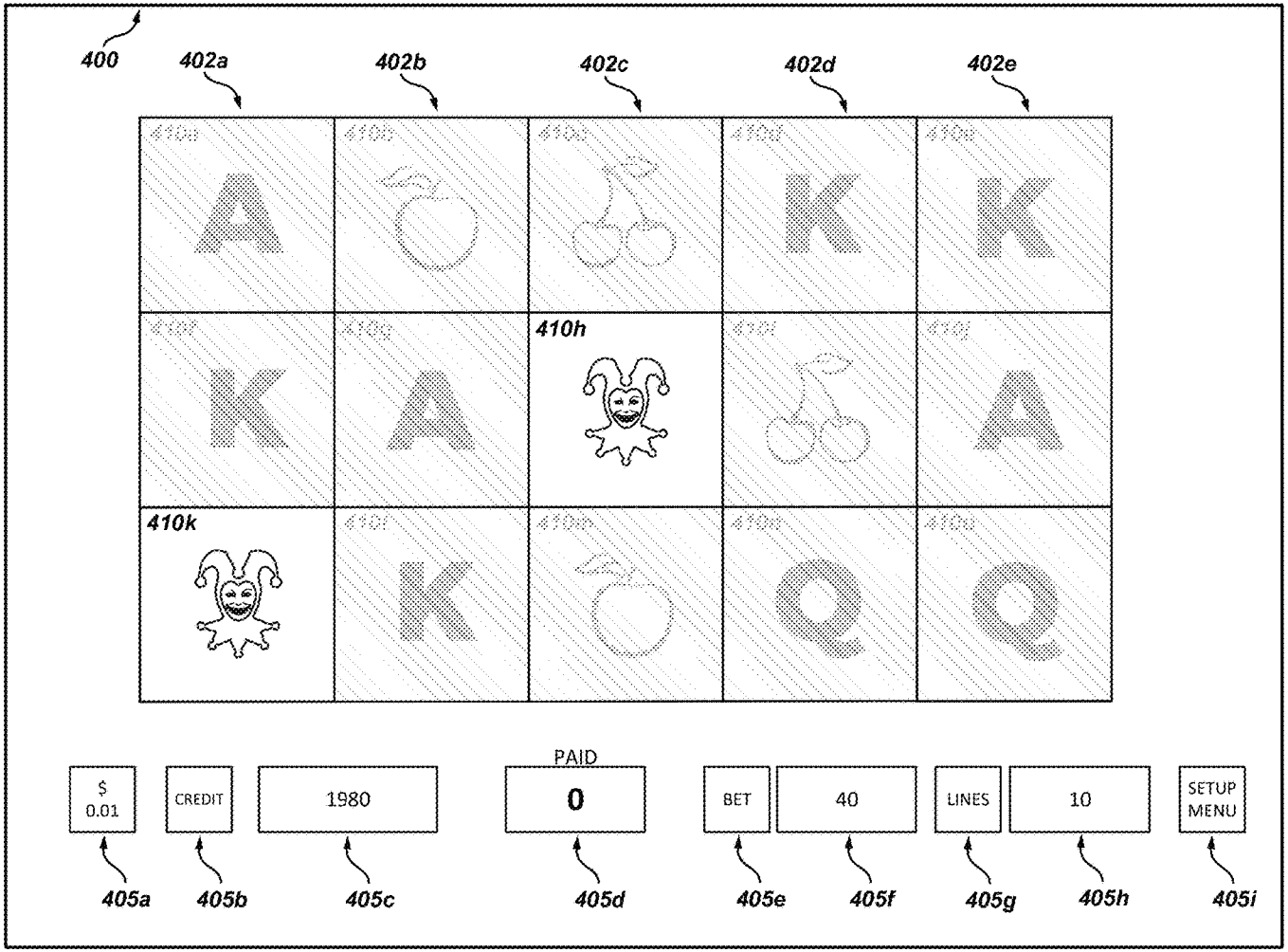

Turning to FIG. 4B, the gaming system kept the symbols that were last displayed in the base game before activating the bonus game. In some implementations, the gaming system shades or partially obscures all of the symbols that are not Joker symbols or Treasure symbols. The gaming system further evaluates the symbols on the reels to determine whether any Joker symbols are displayed. As was illustrated in FIG. 4A, Joker symbols were displayed on reels 402*a*, 402*c*, and 402*d*. Based on these Joker symbols (which are nudge symbols), the gaming system nudges or rotates each of reels 402*a*, 402*c*, and 402*d* down one symbol display position (or moves each of the symbols down one symbol display area). FIG. 4B reflects that symbols on each of reels 402*a*, 402*c*, and 402*d* have moved down one symbol display position. The bottom most symbol each of the reels 402*a*, 402*c*, and 402*d* are removed from the display screen and removed from evaluation. For example, the Cherry symbol, Ace symbol, and Joker symbol in symbol display areas 410*k*, 410*m*, and 410*n* are no longer displayed. The gaming system displayed new symbols Ace, Cherry, and King in symbol display areas 410*a*, 410*c*, and 410*d* respectively. The gaming system also shifted the other symbols in reels 402*a*, 402*c*, and 402*d* down one symbol position. For example, the gaming system shifted: the King symbol in reel 402*a* down to symbol display area 410*f* and the Joker symbol in reel 402*a* down to symbol display area 410*k*; the Joker symbol in reel 402*a* down to symbol display area 410*h* and the Apple symbol down to symbol display area 410*m*; and the Cherry symbol in reel 402*d* down to symbol display area 410*i* and the Queen symbol down to symbol display area 410*n*. It should be appreciated that the displayed symbols can be moved up or down and the movement can include moving more than one symbol display position in alternative implementations.

Figure 4C:
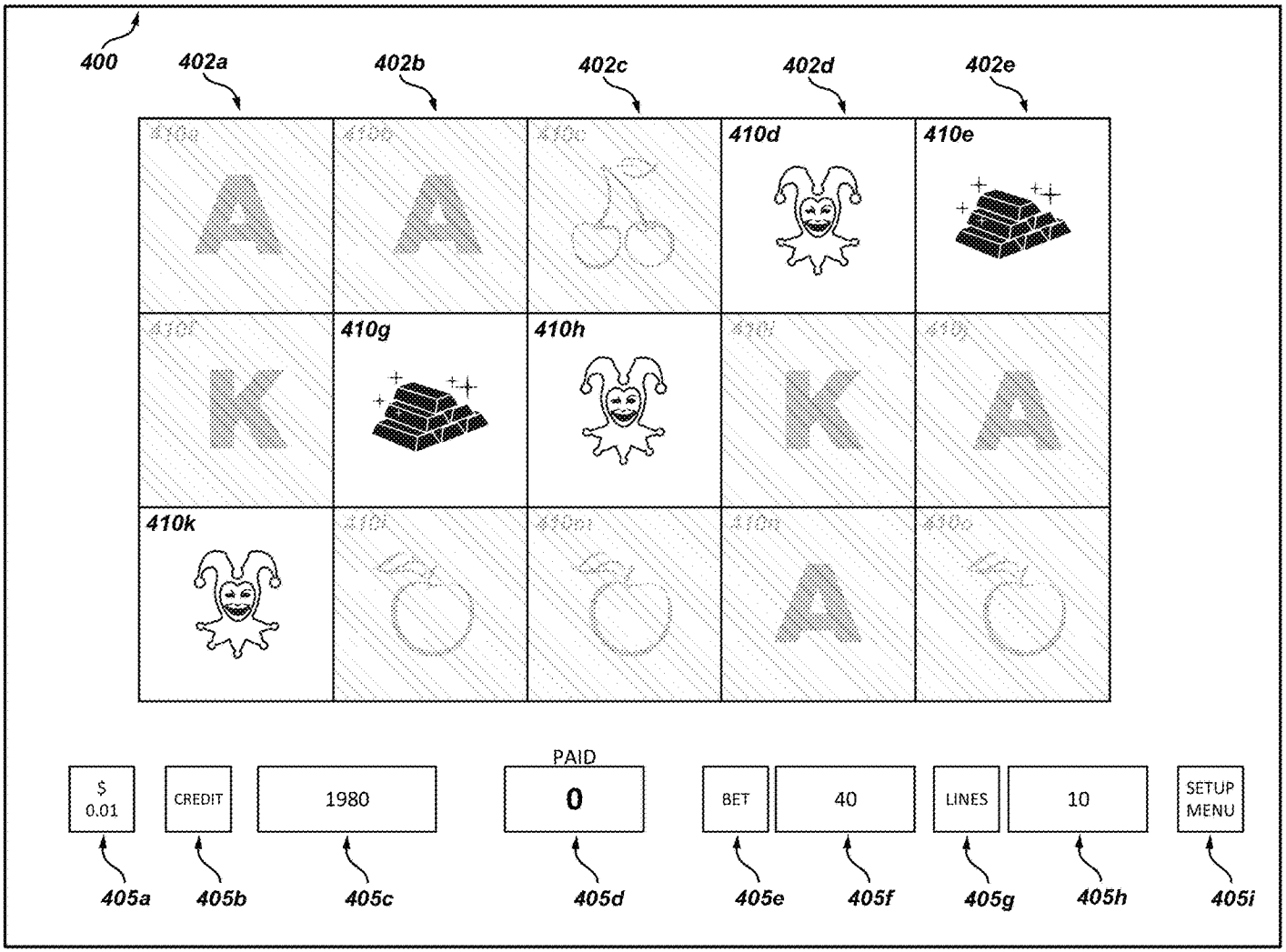

Turning to FIG. 4C, the gaming system also randomly generates (e.g., using a random symbol generation performed by a pseudo RNG, a true RNG, or hardware RNG to generate the symbols) a new plurality of symbols for each reel that does not contain a Joker symbol. In this instance, the gaming system determined that Joker symbols did not appear on reels 402*b*, 402*d*, and 402*e*. Thus, the gaming system generated and displayed new symbols from the symbols sets for the respective reels 402*b*, 402*d*, and 402*e*. As illustrated in FIG. 4C, the gaming system generated an Ace symbol, a Treasure symbol, and an Apple symbol for reel 402*b*; a Joker symbol, a King symbol, and an Ace symbol for reel 402*d*; and a Treasure symbol, an Ace symbol, and an Apple symbol for reel 402*e*. The gaming system evaluates the currently displayed symbols (e.g., a composite of the symbols generated between FIG. 4A-4C), for nudge symbols (e.g., the Joker symbols). If the gaming system determines that Joker symbols are present, the gaming system evaluates the displayed Joker symbols against a pay table to determine if the quantity, arrangement, or a combination of the forgoing of the Joker symbols results in any nudge symbol awards. Thus, it should be appreciated that the nudge symbols, in addition to being scatter symbols that trigger a bonus, also can be function as pay symbols. In this implementation of the bonus game, the nudge symbols are treated as scatter pay symbols. In alternative implementations, the nudge symbols can be line pay symbols that must be generated on wagered pay lines. Returning to FIG. 4C, if the gaming system determines that the displayed Joker symbols result in one or more nudge awards, the gaming system updates the player's gaming credit balance in accordance with any determined awards (not shown).

Figure 4D:
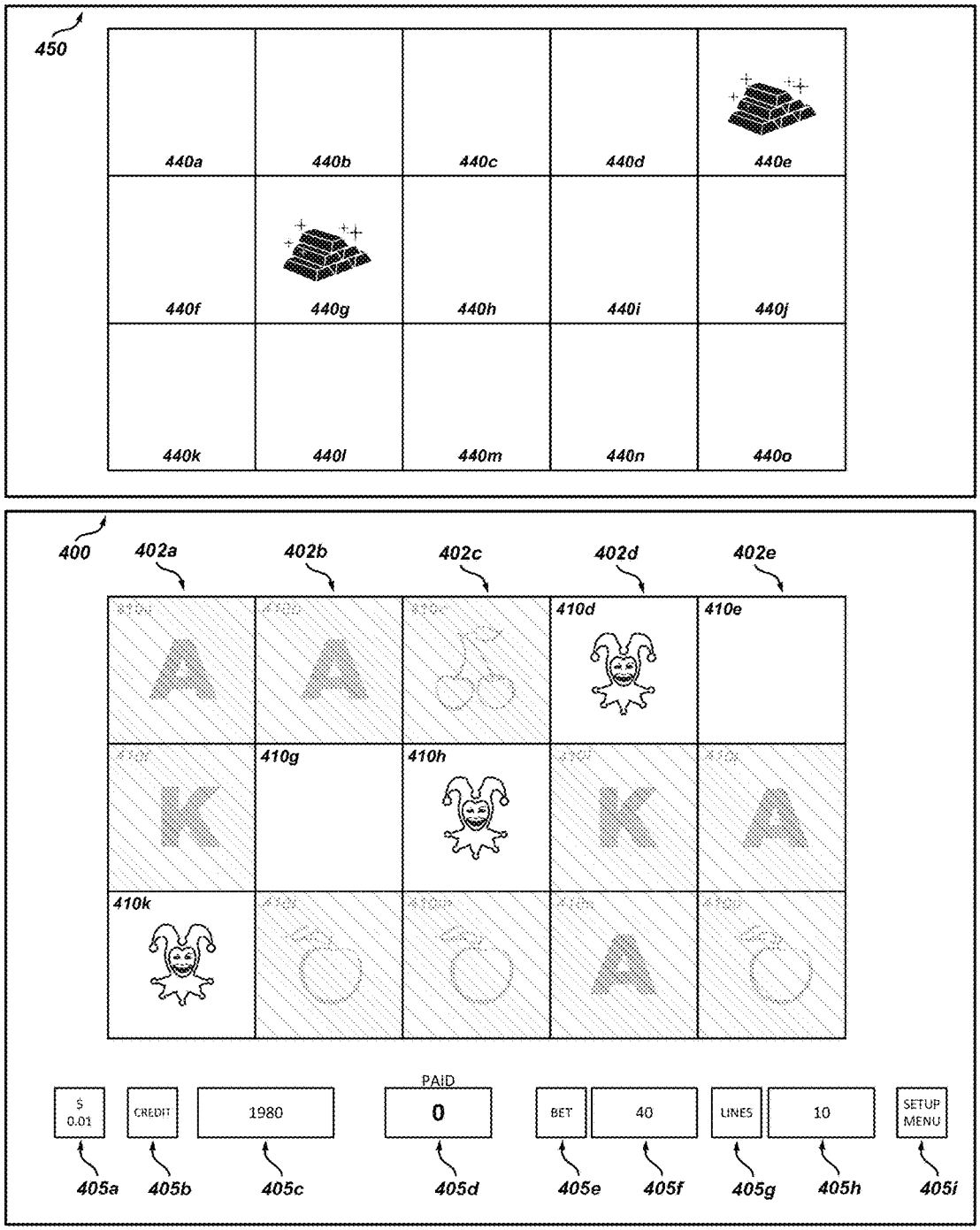

The gaming system, as shown in FIG. 4D, also evaluates the displayed symbols for Treasure symbols (e.g., storage symbols). In FIG. 4D, the gaming system determined that reels 402*b* and 402*e* displayed Treasure symbols in symbol display areas 410*g* and 410*e*, respectively. Based on this determination, the gaming system removes the Treasure symbols from symbol display areas 410*g* and 410*e* and moves the Treasure symbols to a symbol storage area in game display 450. The gaming system stores the Treasure symbols in the symbol storage area for the remainder of the bonus game. In some implementations, game display 450 is displayed on the same display screen as game display 400. In an alternative implementation, game display 450 is displayed on a separate display screen from game display 400. As also shown in FIG. 4D, the gaming system removed the Treasure symbols from symbol display area 410*g* and 410*e* when the gaming system moved the Treasure symbols to the symbol display area of the symbol storage area. In some implementations, the empty symbol display areas 410*g* and 410*e* remain empty until the gaming system generates all new symbols for reels 402*b* and 402*e* during the bonus game. In alternative implementations, the gaming system may cause any symbol above the now empty symbol display areas to shift downward or fall into empty symbol display areas. For example, the gaming system may cause the Ace symbol in symbol display area 410*b* to fall into the symbol display area 410*g*. Likewise, the gaming system may have stored in memory, another symbol that was previously generated for reel 402*e* that is above symbol display area 410*e*, but not displayed. The gaming system may cause this non-visible symbol to fall into symbol display area 410*e*. Alternatively, the gaming system may generate new symbols just for the empty symbol display areas. In some such implementations, the gaming system may reevaluate the newly generated symbols for Joker symbols and Treasure symbols.

In some implementations, the symbol storage area includes a plurality of symbol display areas 440*a*, 440*b*, 440*c*, 440*d*, 440*e*, 440*f*, 440*g*, 440*h*, 440*i*, 440*j*, 440*k*, 440*l*, 440*m*, 440*n*, and 440*o* as illustrated in FIG. 4D. In some implementations, each of these symbol display areas in the symbol storage area are associated with or correspond to the symbols display areas 410*a*-410*o* in game display 400. When the symbol display areas 440*a*-440*o* and the symbol display areas 410*a*-410*a* are associated, the gaming system moves displayed Treasure symbols from a symbol display area 410*a*-410*o* to a corresponding one of the symbol display areas 440*a*-440*o*. For example, symbol display area 410*g* corresponds to symbol display area 440*g*. As such, if the gaming system determines that a Treasure symbol is displayed in symbol display area 410*g*, the gaming system moves that Treasure symbol to symbol display area 440*g* for storage. It should be appreciated that in some implementations, the gaming system does not associate symbol display areas 410*a*-410*o* to 440*a*-440*o*. In some such implementations, the gaming system may move Treasure symbols to any suitable empty symbol display area in the symbol display areas 440*a*-440*o*. In some implementations, the symbol storage area may include fewer or more symbol display areas than symbol display areas on reels 402*a*-402*e*.

After storing the Treasure symbols in the symbol storage area, the gaming system determines whether any Joker symbols (e.g., nudge symbols) remain displayed. If at least one Joker symbol remains displayed, the gaming system may repeat the above mentioned actions for the bonus game. It should be appreciated that in some implementations, the gaming system may require more than one Joker symbol to be displayed to continue the bonus game. Alternatively, the quantity of Joker symbols required to be displayed to continue the game can be tied to the amount of the player's wager. For example, the more credits the player wagers, the fewer Joker symbols are required to be displayed to continue the bonus game. For example, for a bet of 120 credits, the gaming system may require at least three Joker symbols to be displayed for the bonus game to continue in some implementations. Whereas, for a bet of 200 credits, the gaming system may require just one Joker symbol to be displayed to continue the bonus game. However, as discussed in the implementation below, the gaming system continues the bonus game so long as one Joker symbols is displayed (regardless of the player's wager).

Figure 4E:
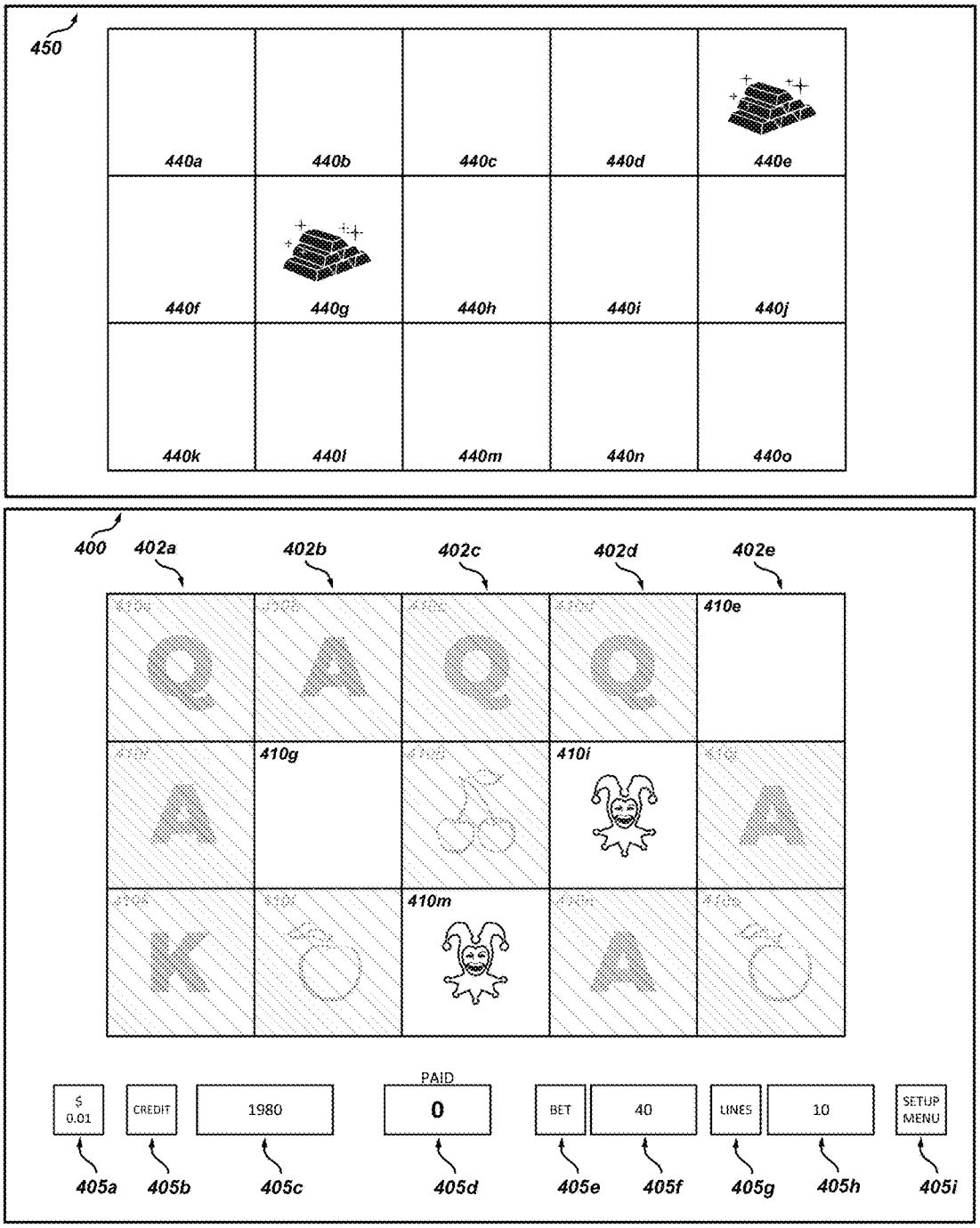

Turning to FIG. 4E, the gaming system repeats the execution of the bonus game features described in corresponding FIG. 3C (e.g., blocks 367-376) because the gaming system determined that at least one Joker symbol remained displayed. For example, the gaming system determines that Joker symbols are displayed on reels 402*a*, 402*c*, and 402*d*. As such, the gaming system nudges the symbols displayed on these reels down one symbol display position as illustrated in FIG. 4E. The movement of the symbols causes the Joker symbol to be removed from reel 402*a* and also causes the Joker symbols on reels 402*c* and 402*d* to move down, but remain displayed on the game display 400. The other symbols on reels 402*a*, 402*c*, and 402*d* are also moved down in accordance with the reel nudges or rotations.

Figure 4F:
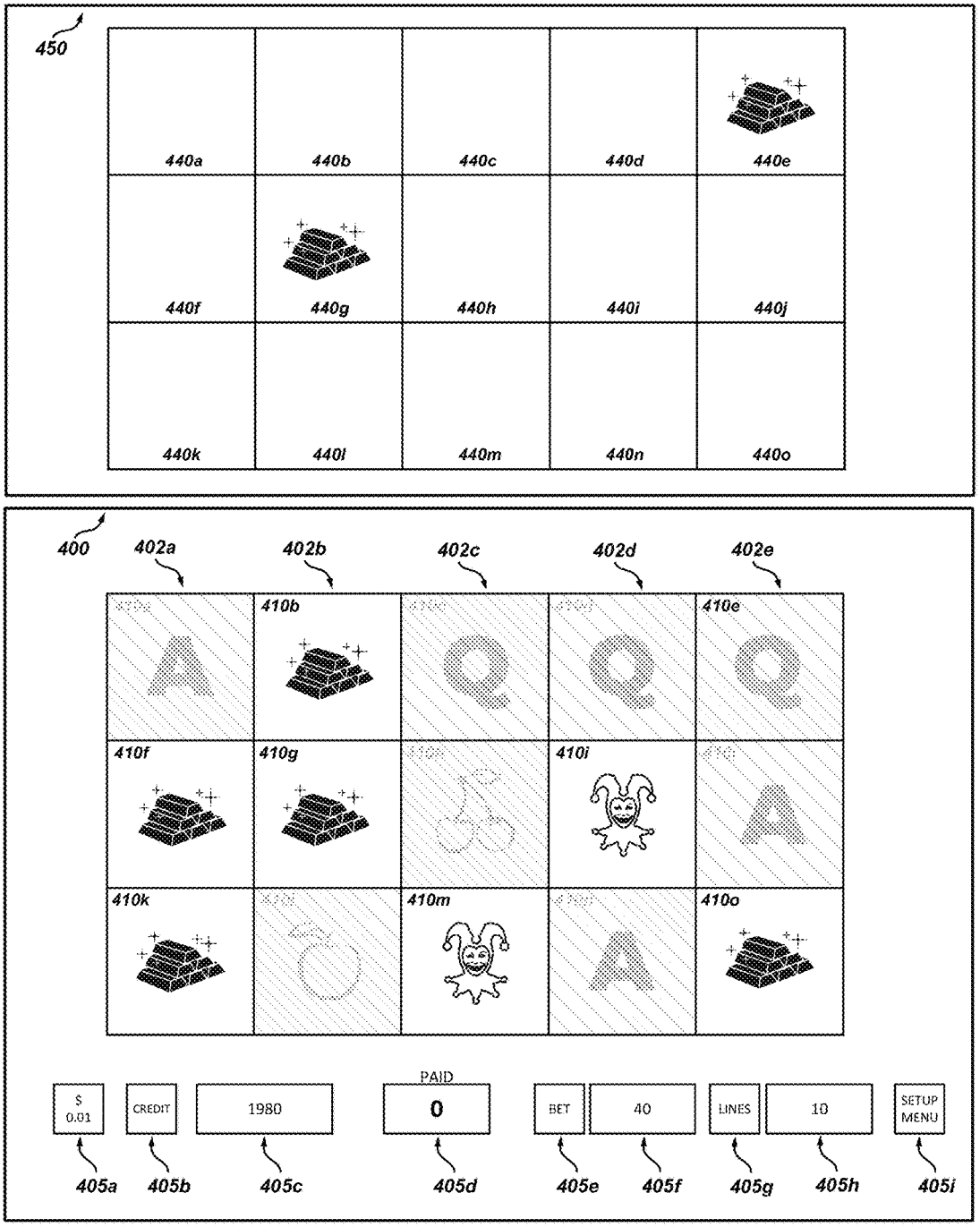

Turning to FIG. 4F, the gaming system randomly generates a new plurality of symbols for each reel that does not contain a Joker symbol. In this instance, the gaming system determined that Joker symbols did not appear on reels 402*a*, 402*b*, and 402*e*. Thus, the gaming system generated and displayed new symbols from the symbols sets for the respective reels 402*a*, 402*b*, and 402*e*. As illustrated in FIG. 4F, the gaming system generated, among other symbols, two Treasure symbols for reel 402*a*, two Treasure symbols for reel 402*b*, and one Treasure symbol for reel 402*e*. The gaming system also evaluates the currently displayed symbols (e.g., a composite of the previously displayed symbols that were not removed on reels 402*c* and 402*d* and the new replacement symbols generated for reels 402*a*, 402*b*, and 402*e*) for Joker symbols. If the gaming system determines that Joker symbols are present, the gaming system evaluates the displayed Joker symbols against a pay table to determine if the quantity, arrangement, or a combination of the forgoing of the Joker symbols results in any nudge symbol awards. The gaming system may update the player's gaming credit balance in accordance with any determined award associated with the Joker symbols.

In some implementations, the gaming system evaluates all currently displayed symbols. However, in some implementations, the gaming system skips evaluating symbols that are not Joker symbols or Treasure symbols. By skipping evaluation of all of the displayed symbols, the efficiency of the gaming system can be improved because less memory and less processing power is used during the gaming system's evaluation for each round of the bonus game. This efficiency also translates into faster game play because less time is used to complete the game's evaluation. When such efficiency improvements are made and applied to the hundreds and thousands of game evaluations that are made on a casino floor for the disclosed gaming system, the new gaming system will provide casino game operators sizable gains in machine efficiency, which is a technological improvement.

Figure 4G:
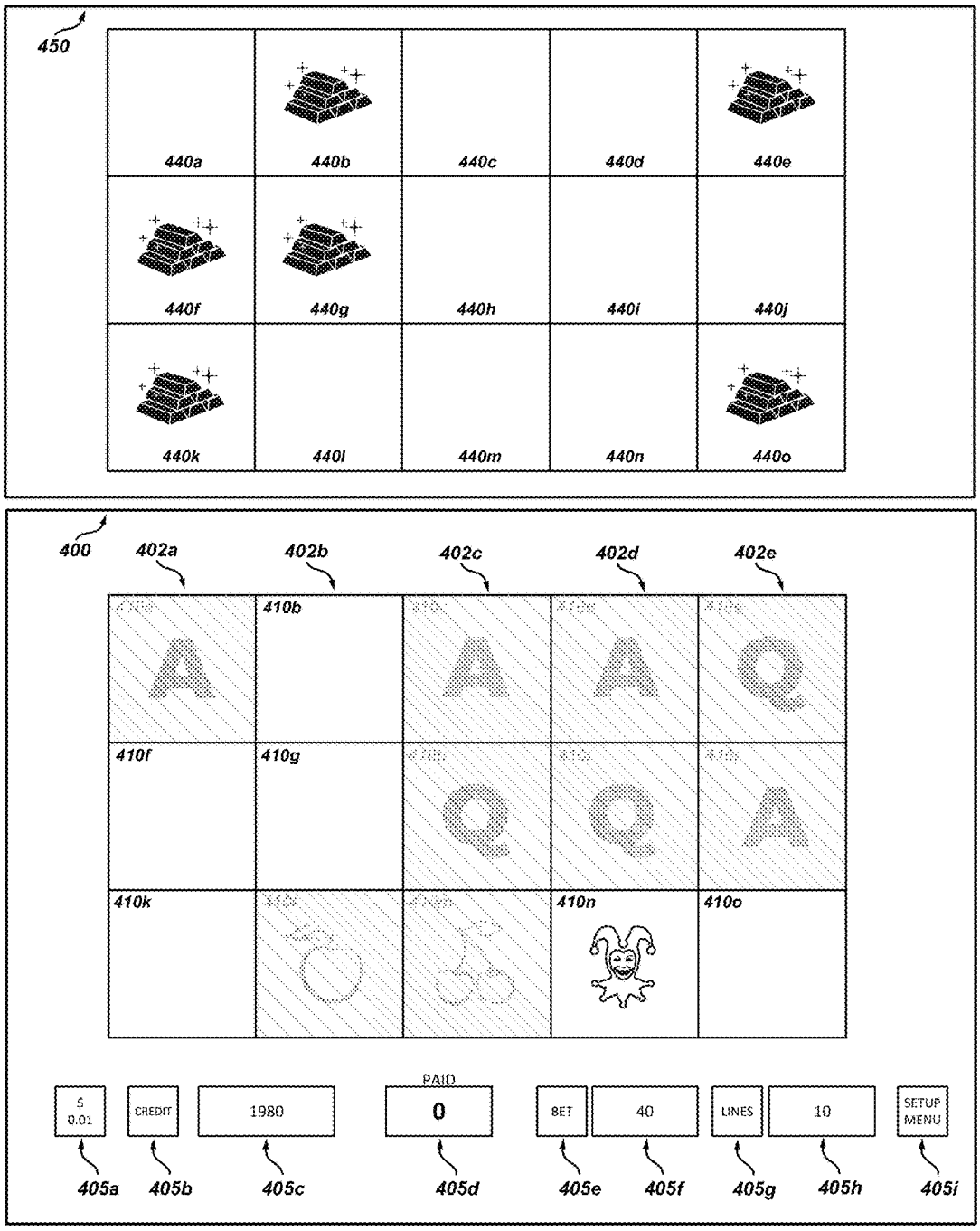

The gaming system, as shown in FIG. 4G, also evaluates the displayed symbols for Treasure symbols (e.g., storage symbols). In FIG. 4G, the gaming system determined that reels 402*a*, 402*b*, and 402*e* displayed Treasure symbols in symbol display areas 410*b*, 410*f*, 410*g*, 410*k*, and 410*o*, respectively. Based on this determination, the gaming system removes the Treasure symbols from symbol display areas 410*b*, 410*f*, 410*g*, 410*k*, and 410*o* and moves these Treasure symbols to a corresponding symbol storage area in game display 450. In some implementations, once the gaming system stores a Treasure symbol in the symbol storage area, the stored Treasure symbol is removed from an associated symbol set so that such a stored Treasure symbol is not generated again for the current play of the game. However, in alternative implementations, the quantity of available Treasure symbols that the gaming system uses to generate symbols from the plurality of symbol sets does not change during the play of a game, even when Treasure symbols are moved.

After storing the Treasure symbols in the symbol storage area, the gaming system determines whether any Joker symbols remain displayed. If at least one Joker symbol remains displayed, the gaming system may again repeat the above mentioned actions for the bonus game.

Turning to FIG. 4G, the gaming system repeats the execution of the bonus game features described in corresponding FIG. 3C (e.g., blocks 367-376) because the gaming system determined that at least one Joker symbol remained displayed. For example, the gaming system determines that Joker symbols are displayed on reels 402*c* and 402*d* in FIG. 4F. As such, the gaming system nudges the symbols displayed on these reels down one symbol display position as illustrated in FIG. 4G. The movement of the symbols causes the Joker symbol to be removed from reel 402*c* and also causes the Joker symbol on reel 402*d* to move down, but remain displayed on the game display 400. The other symbols on reels 402*c* and 402*d* are also moved down.

Figure 4H:
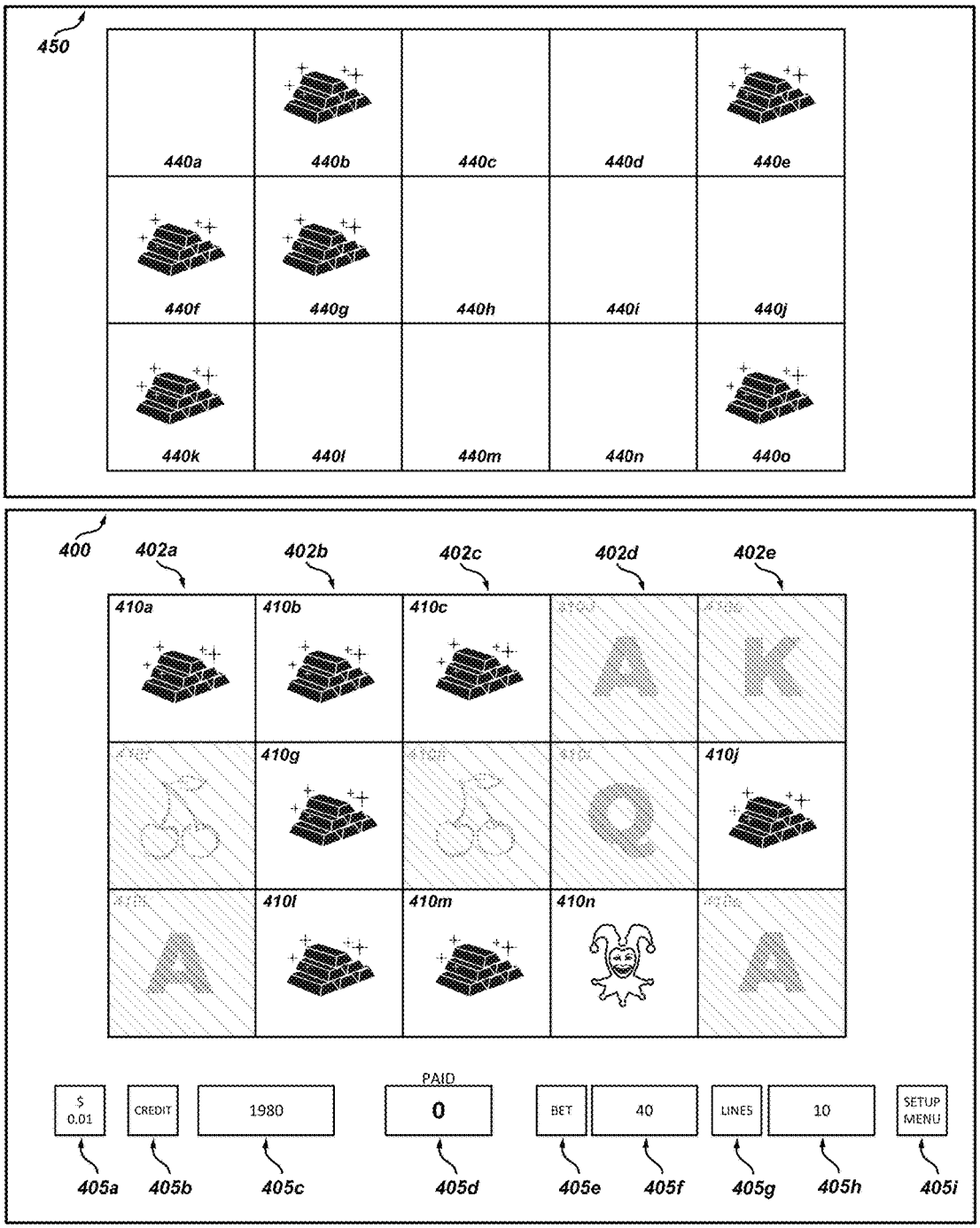

Turning to FIG. 4H, the gaming system randomly generates a new plurality of symbols for each reel that does not contain a Joker symbol. In this instance, the gaming system determined that Joker symbols did not appear on reels 402*a*, 402*b*, 402*c*, and 402*e*. Thus, the gaming system generated and displayed new symbols from the symbol sets for the respective reels 402*a*, 402*b*, 402*c*, and 402*e*. As illustrated in FIG. 4H, the gaming system generated, among other symbols, one Treasure symbol for reel 402*a*, three Treasure symbols for reel 402*b*, two Treasure symbols for reel 402*c*, and one Treasure symbol for reel 402*e*. The gaming system also evaluates the currently displayed symbols (e.g., a composite of the previously displayed symbols that were not removed on reel 402*d* and the new replacement symbols generated for reels 402*a*, 402*b*, 402*c*, and 402*e*) for Joker symbols. If the gaming system determines that Joker symbols are present, the gaming system evaluates the displayed Joker symbols against a pay table to determine if the quantity, arrangement, or a combination of the forgoing of the Joker symbols results in any nudge symbol awards. The gaming system may update the player's gaming credit balance in accordance with any determined award associated with the Joker symbols.

The gaming system, as shown in FIG. 4H, also evaluates the displayed symbols for Treasure symbols (e.g., storage symbols). In FIG. 4H, the gaming system determined that reels 402*a*, 402*b*, 402*c*, and 402*e* displayed Treasure symbols in symbol display areas 410*a*, 410*b*, 410*c*, 410*g*, 410*j*, 410*l*, and 410*m*, respectively. Based on this determination, the gaming system removes the Treasure symbols from symbol display areas 410*a*, 410*b*, 410*c*, 410*g*, 410*j*, 410*l*, and 410*m* and moves these Treasure symbols to associated symbol display areas in the symbol storage area in game display 450.

After storing the Treasure symbols in the symbol storage area, the gaming system determines whether any Joker symbols remain displayed. If at least one Joker symbol remains displayed, the gaming system may again repeat the above mention actions for the bonus game.

In some implementations, as illustrated in FIG. 4H, the gaming system may generate Treasure symbols in the symbol display areas of the reels when corresponding Treasure symbols are already stored in the corresponding symbol display areas of the symbol storage area. In some implementations, the gaming system may ignore the duplication of the Treasure symbols for the same symbol display area in the symbol storage area. Thus, in such implementations, the duplication of the Treasure symbols do not result in any greater award. However, in alternative implementations, the gaming system may track the duplication of the Treasure symbols for award enhancements (e.g., award multipliers or other suitable awards). For example, the gaming system previously stored a Treasure symbol in symbol display area 440*b* of the symbol storage area, as illustrated in FIG. 4H. The gaming system also generated a new Treasure symbol 410*b* on reel 402*b* that may be moved to an already occupied symbol display area 440*b*. In some implementations, the gaming system tracks the duplication of Treasure symbols and creates a multiplier for each stored duplication. Thus, in some implementations of FIG. 4H, when the gaming system moves the new Treasure symbol in 410*b* to 440*b*, the gaming system creates and stores in memory that this duplication of Treasure symbols creates a 2× multiplier for any resulting award for the Treasure symbol in 440*b* (or the 2× multiplier can be applied to the entirety of the bonus game award in some implementations). If another Treasure symbol is moved to the same symbol display area 440*b* later in the bonus game, the gaming system may increase the multiplier to 3×. It should be appreciated that the multipliers may be increased more than 1× for each duplication. In other implementations, the gaming system may remove a Treasure symbol from the symbol storage area if Treasure symbol duplication occurs, potentially decreasing the available Treasure symbols that the player collects during a play of the game.

Figure 4I:
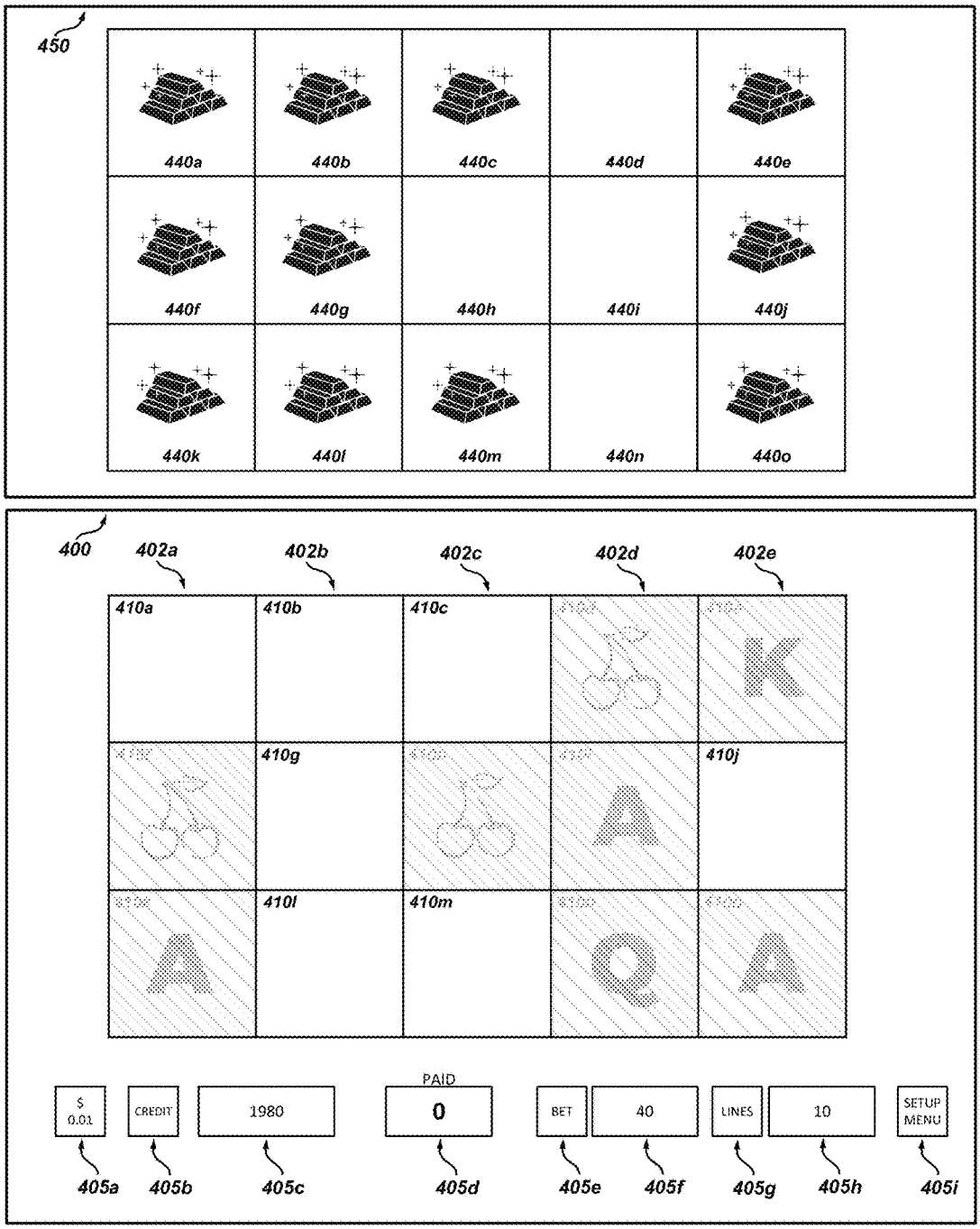

Turning to FIG. 4I, the gaming system repeats the execution of the bonus game features described in corresponding FIG. 3C (e.g., blocks 367-376) because the gaming system determined that at least one Joker symbol remained displayed. For example, the gaming system determines that one Joker symbol remains displayed on reel 402*d* in FIG. 4H. As such, the gaming system nudges the symbols displayed on this reel down one symbol display position as illustrated in FIG. 4I. The movement of the symbols causes the Joker symbol to be removed from reel 402*d*. The other symbols on reels 402*c* and 402*d* are also moved down.

Figure 4J:
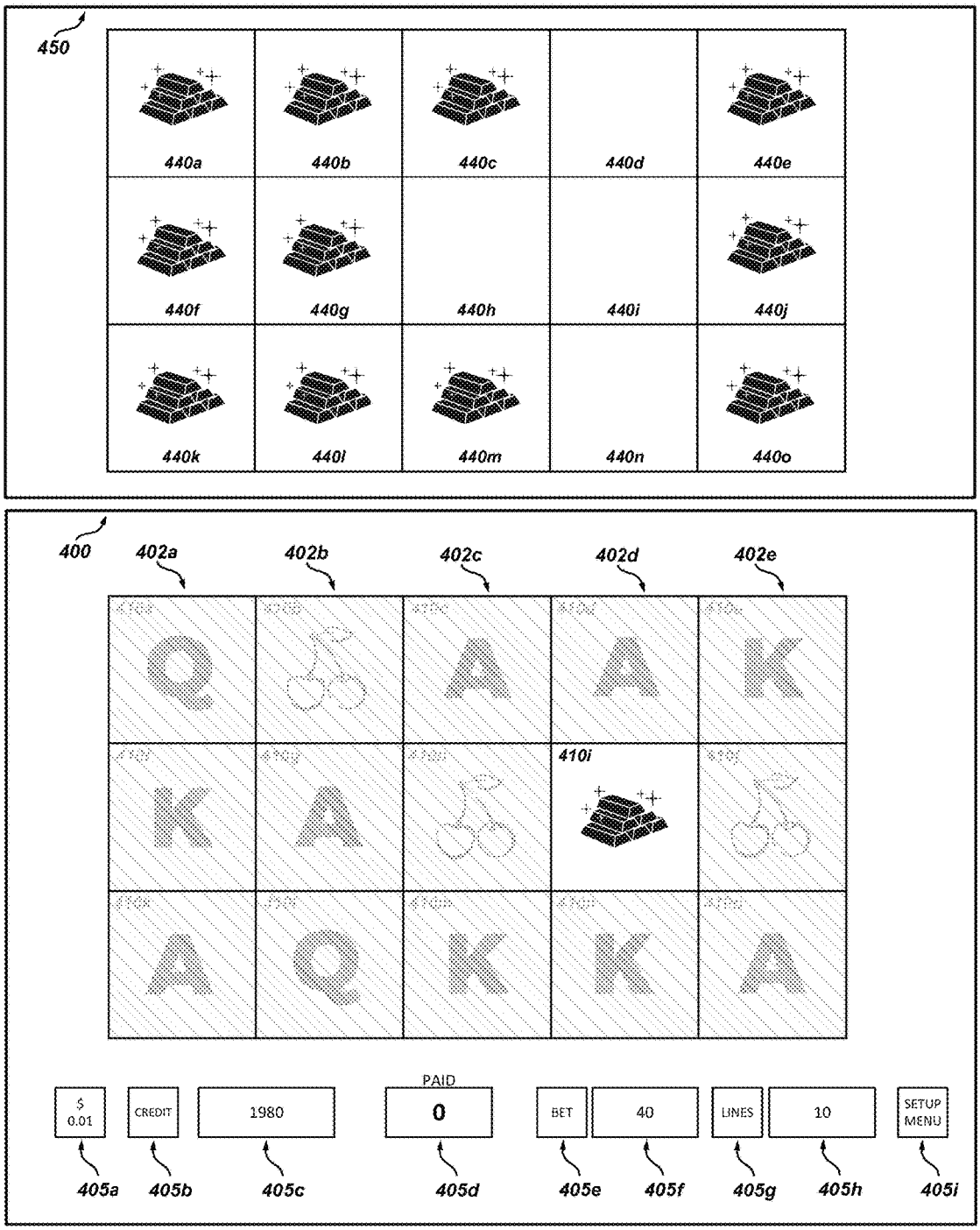

Turning to FIG. 4J, the gaming system randomly generates a new plurality of symbols for each reel that does not contain a Joker symbol. In this instance, the gaming system determined that Joker symbols did not appear on reels 402*a*, 402*b*, 402*c*, 402*d*, and 402*e*. Thus, the gaming system generated and displayed new symbols from the symbols sets for the respective reels 402*a*-402*e*. As illustrated in FIG. 4J, the gaming system generated, among other symbols, one Treasure symbol for reel 402*d*. The gaming system also evaluates the currently displayed symbols (e.g., a composite of the previously displayed symbols that were not removed on reel 402*d* and the new replacement symbols generated for reels 402*a*, 402*b*, 402*c*, and 402*e*) for Joker symbols. If the gaming system determines that Joker symbols are present, the gaming system evaluates the displayed Joker symbols against a pay table to determine if the quantity, arrangement, or a combination of the forgoing of the Joker symbols results in any nudge symbol awards. The gaming system may update the player's gaming credit balance in accordance with any determined award associated with the Joker symbols. In FIG. 4J, no Joker symbols remain, thus the gaming system does not provide any nudge symbol awards.

Figure 4K:
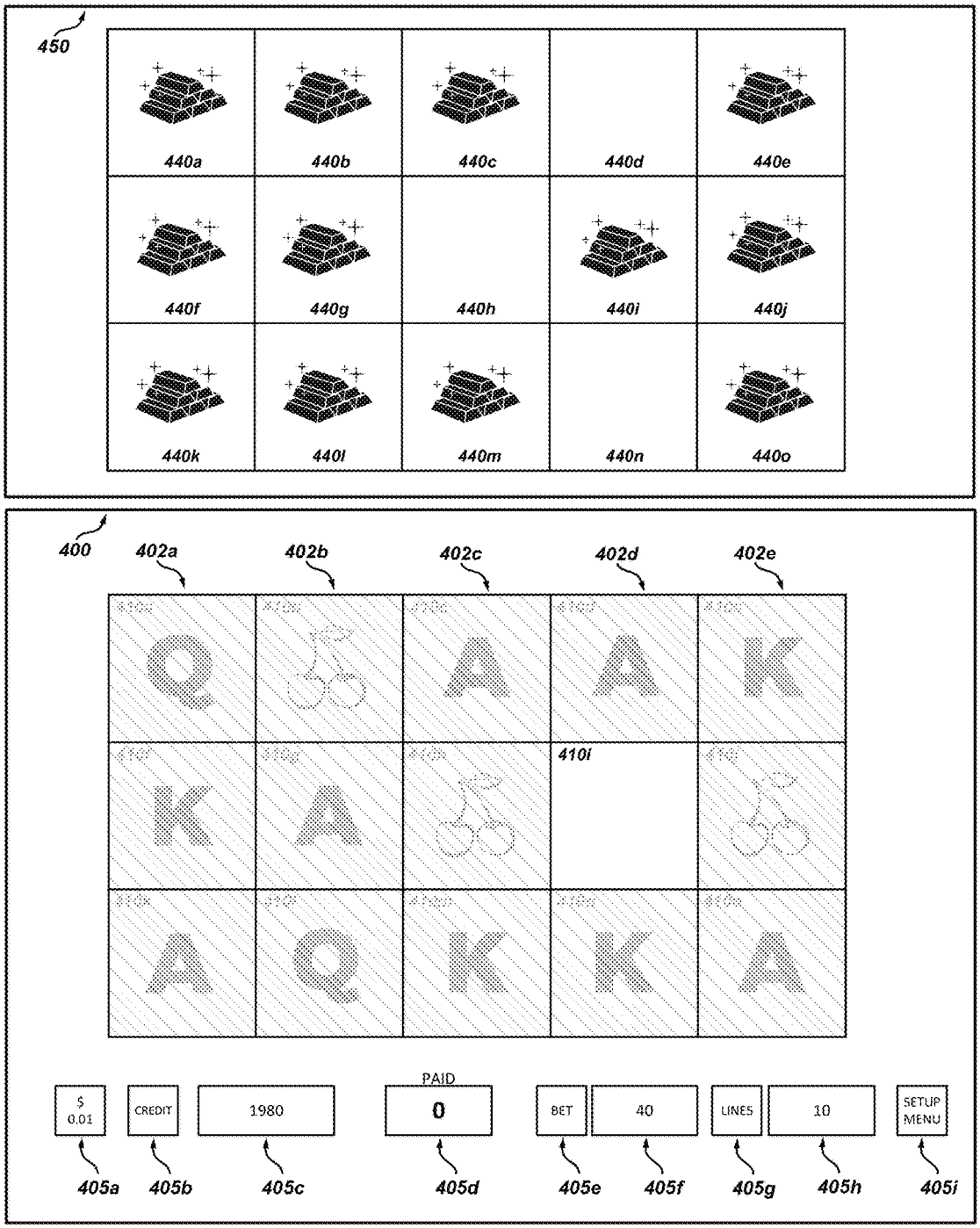

The gaming system, as shown in FIG. 4J, also evaluates the displayed symbols for Treasure symbols (e.g., storage symbols). In FIG. 4J, the gaming system determined that reel 402*d* displayed one Treasure symbol in symbol display area 410*i*. Based on this determination, the gaming system removes this Treasure symbol from the symbol display areas 410*i* and moves this Treasure symbol to the corresponding symbol display area 440*i* in symbol storage area in game display 450 as illustrated in FIG. 4K.

Figure 4L:
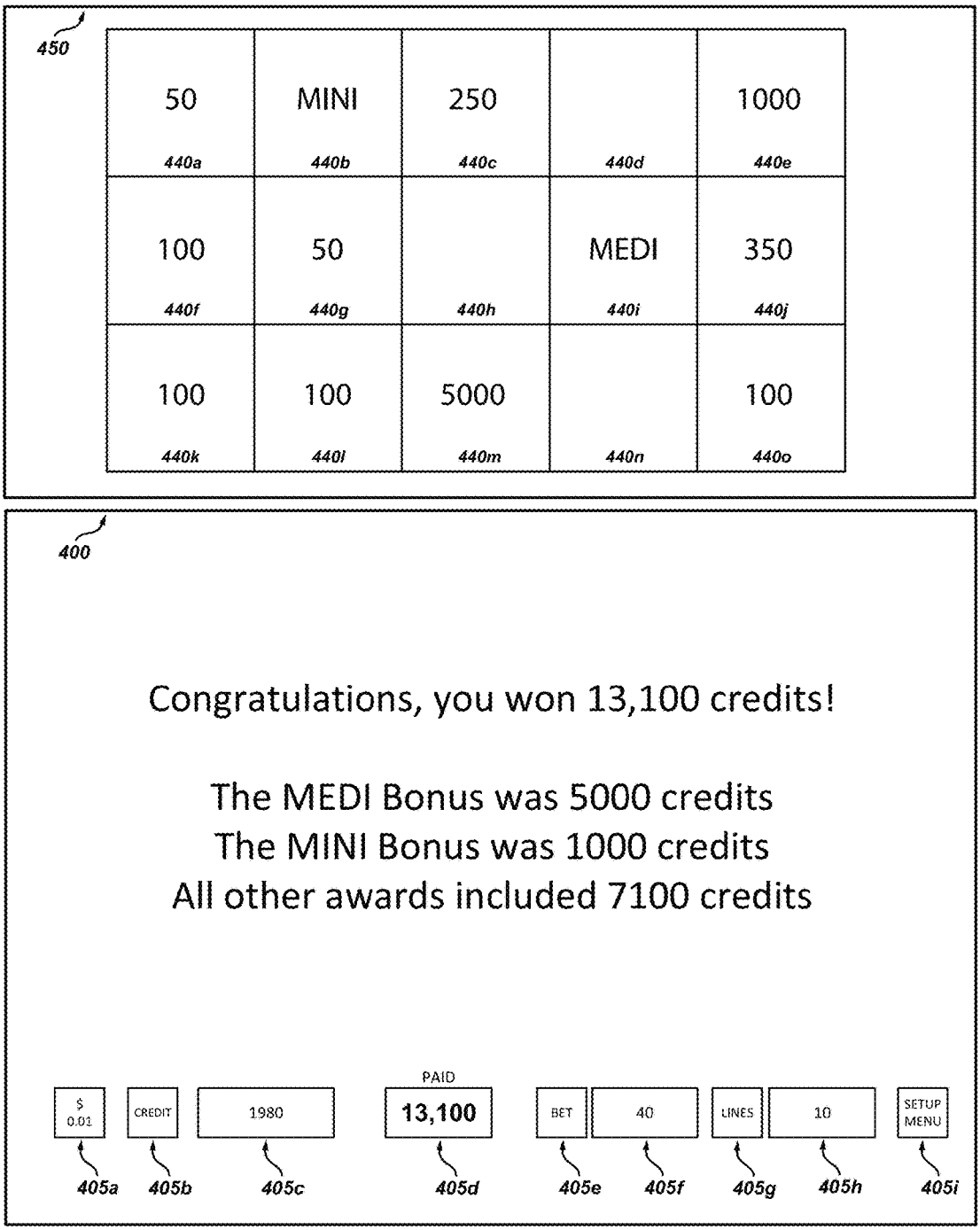

After storing the Treasure symbols in the symbol storage area, the gaming system determines whether any Joker symbols remain displayed. If at least one Joker symbol remains displayed, the gaming system may again repeat the above mention actions for the bonus game. As shown in FIG. 4K, no Joker symbols remain. Therefore, the gaming system converts the stored Treasure symbols displayed in the symbol storage area of game display 450 into storage symbol award values, as illustrated in block 380 of FIG. 3D. As illustrated in FIG. 4L, the gaming system displays such converted storage symbol award values. In some implementations, the gaming system randomly generates the storage symbol award values from a set of award values for the conversion. In some implementations, the set of award values includes numeric credit awards. In some implementations, the numeric credit awards are fixed numeric credit awards that do not change based on game inputs. In some implementations, the set of award values includes numeric awards, bonus awards, internal jackpot awards, linked jackpot awards (e.g., from linked network gaming systems), or some combination of the forgoing. In some implementations, the bonus awards change based on the player's wager for the current play of the game, while the internal jackpot and linked jackpot may change based on wagers over time. In some implementations, the gaming system selects the storage symbol award values at the end of the last bonus round for the game. In alternative implementations, the gaming system selects the storage symbol award values at any suitable time before or during the play of the game.

As also illustrated in FIG. 4L, the gaming system determines a payout amount for the bonus game based on the displayed storage symbol award values for each converted Treasure symbol in the storage symbol display area. The gaming system updates the player's gaming credit balance (405*d*) in accordance with the calculated award amount for the bonus game. As further illustrated in FIG. 4L, the gaming system also displayed a message to the player indicating how many credits the player won. In some implementations, the gaming system may display the breakdown of the credit awards (e.g., from the MEDI Bonus, MINI bonus, and the displayed credit awards values). The bonus game and the play of the game ends.

The player may continue the gaming session (e.g., another consecutive play of the game) by executing another play of the game. That is, the player may place another wager and start a new play of the game as noted above. However, continued game play is dependent of the number of credits remaining in the player's credit balance. The player may also choose to cash out. In such an instance, the gaming system provides the player a value based on the player's credit balance using any of the value items discussed above (bills, coins, vouchers, etc.).

Based on the forgoing description, it should be appreciated that a gaming system and method with improvements to game outcomes creates new and very exciting ways for a player to obtain improved winnings with a potential to earn greater awards. Such a potential to earn greater awards creates a greatly improved sense of anticipation for players.

A number of implementations of the invention have been described. Various modifications may be made without departing from the spirit and scope of the invention. For example, various forms of the flows shown above may be used, with steps re-ordered, added, or removed. Accordingly, other implementations are within the scope of the following claims.

We claim:

1. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via the input device, the credit balance being decreased by the wager;

randomly generate a first plurality of symbols from a plurality of symbol sets;

display, on the display device, the first plurality of symbols in a plurality of symbol display areas, the first plurality of symbols are associated with a separate one of the plurality of symbol display areas and the plurality of symbol display areas being arranged in a plurality of columns;

determine that a nudge symbol is in the first plurality of symbols, wherein the nudge symbol causes the processor to move displayed symbols, the move further comprising removing the nudge symbol from the plurality of symbol display areas where the nudge symbol is displayed in a bottom row of the plurality of symbol display areas, and wherein the nudge symbol controls whether the processor generates one or more additional plurality of symbols for one or more of the plurality of columns;

randomly generate and display, based on the determination that the nudge symbol is in the plurality of symbols, a second plurality of symbols for at least one of the plurality of columns that does not display the nudge symbol, the second plurality of symbols replacing the first plurality of symbols in the at least one of the plurality of columns, the displayed second plurality of symbols and the remaining displayed first plurality of symbols comprising currently displayed symbols;

display, on the display device, any determined nudge awards based on the nudge symbol in the currently displayed symbols;

determine whether the currently displayed symbols include one or more storage symbols;

store the one or more storage symbols in a symbol storage area displayed separate from the plurality of symbol display areas;

convert the storage symbols to storage symbol award values;

display, on the display device, the storage symbol award values, the credit balance being increased by the storage symbol award values; and issue value from the value dispenser based on the credit balance upon receipt of a cash out signal.

2. The gaming system of claim 1, wherein the processor further:

determines if the first plurality of symbols in the plurality of symbol display areas includes a predetermined quantity of nudge symbols to trigger a bonus game.

3. The gaming system of claim 2, wherein upon activating the bonus game, the processor further:

for at least one of the plurality of columns that includes the nudge symbol, move each symbol in the symbol display areas of the at least one of the plurality of columns down one symbol display area;

display a new symbol in a top most symbol display area of the at least one column; and remove from the display, a symbol in a bottom most symbol display area of the at least one column.

4. The gaming system of claim 3, wherein the plurality of columns comprise different reels having a plurality of symbol display areas; and the processor rotates the reel to reveal the new symbol and to remove a displayed symbol of the generated plurality of symbols.

5. The gaming system of claim 2, wherein the bonus game does not require receiving is activated without an additional wager from the player.

6. The gaming system of claim 2, wherein at least one storage symbol is added to at least one of the plurality of symbol sets upon activating the bonus game.

7. The gaming system of claim 1, wherein the storage symbols have no monetary value.

8. The gaming system of claim 2, wherein a quantity of storage symbols added to at least one of the plurality of symbol sets upon activating the bonus game ranges from zero to a quantity equal to the quantity of the plurality of symbol display areas.

9. The gaming system of claim 1, wherein storing the storage symbols in the symbol storage area comprises removing the one or more storage symbols from the plurality of symbol display areas.

10. The gaming system of claim 1, wherein the symbol storage area is displayed on a second display device.

11. The gaming system of claim 2, wherein symbols other than nudge symbols and storage symbols do not result in awards during the bonus game.

12. The gaming system of claim 2, wherein the nudge symbol is associated with at least four different game functions during a play of a game.

13. The gaming system of claim 12, wherein the nudge symbol is associated with different ones of the four different game function based on whether the bonus game is active.

14. The gaming system of claim 12, wherein the nudge symbol does not trigger an additional bonus game once the bonus game is active and the nudge symbol becomes a pay symbol during the bonus game.

15. The gaming system of claim 2, wherein the bonus game ends when no nudge symbols are displayed.

16. The gaming system of claim 1, wherein converting the storage symbols to the storage symbols award values occurs after the processor determines that no nudge symbols remain displayed.

17. The gaming system of claim 16, wherein converting the storage symbols to the storage symbols award values further comprises randomly determining and assigning a value from a plurality of different values or one of a plurality of jackpot values for each storage symbol in the symbol storage area.

18. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

randomly generating a first plurality of symbols;

displaying, on a display device of the housing, the first plurality of symbols in a plurality of symbol display areas, each of the first plurality of symbols being associated with a separate one of the plurality of symbol display areas and the plurality of symbol display areas being arranged in a plurality of columns;

determining, with the processor, if a nudge symbol was generated in the first plurality of symbols, wherein the nudge symbol causes the processor to move displayed symbols, the move further comprising removing the nudge symbol from the plurality of symbol display areas where the nudge symbol is displayed in a bottom row of the plurality of symbol display areas, and the nudge symbol controls whether the processor generates one or more additional plurality of symbols for one or more of the plurality of columns;

randomly generating and displaying, using the processor, a second plurality of symbols for at least one of the plurality of columns that does not display the nudge symbol, the second plurality of symbols replacing the first plurality of symbols in the at least one of the plurality of columns, the displayed second plurality of symbols and the remaining displayed first plurality of symbols comprising currently displayed symbols;

displaying, on the display device, any determined nudge awards based on the nudge symbol in the currently display symbols;

determining, with the processor, if any storage symbols were generated in the currently displayed symbols;

storing any determined storage symbols in a symbol storage area separate from the plurality of symbol display areas;

converting the storage symbols to storage symbol award values;

displaying, on the display device, the storage symbol award values, the credit balance being increased by the storage symbol award values;

increasing, by the processor, the credit balance by the storage symbol award values; and issuing another monetary value, by the value dispenser, based on the credit balance upon receipt of a cash out signal.

19. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via an input device, the credit balance being decreased by the wager;

randomly generate a first plurality of symbols;

display, on the display device, the first plurality of symbols in a plurality of symbol display areas, each of the first plurality of symbols being associated with a separate one of the plurality of symbol display areas;

determine if any nudge symbols were generated in the first plurality of symbols wherein the nudge symbols cause the processor to move displayed symbols, the move further comprising removing at least one of the nudge symbols from the plurality of symbol display areas where the at least one of the nudge symbols is displayed in a bottom row of the plurality of symbol display areas, and the nudge symbols control whether the processor generates one or more additional plurality of symbols for one or more of the plurality of columns;

display, on the display device, any determined nudge awards based on at least one winning nudge symbol combination if the nudge symbols form the at least one winning nudge symbol combination;

determine if any storage symbols were generated in the first plurality of symbols;

store any determined storage symbols in a symbol storage area separate from the plurality of symbol display areas;

convert the storage symbols to storage symbol award values;

display, on the display device, the storage symbol award values, the credit balance being increased by the storage symbol award values; and issue value from the value dispenser based on the credit balance upon receipt of a cash out signal.

* * * * *